US006537662B1

(12) United States Patent
Kamrath et al.

(10) Patent No.: US 6,537,662 B1
(45) Date of Patent: Mar. 25, 2003

(54) SOIL-RESISTANT SPIN FINISH COMPOSITIONS

(75) Inventors: Robert F. Kamrath, Mahtomedi, MN (US); James E. Lockridge, Maplewood, MN (US); Edward R. Hauser, St. Croix, WI (US); Irvin F. Dunsmore, Ham Lake, MN (US); Chetan P. Jariwala, Woodbury, MN (US); Nicole L. Franchina, Afton, MN (US); Roger R. Alm, Lake Elmo, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 09/228,460

(22) Filed: Jan. 11, 1999

(51) Int. Cl.[7] ..... D06M 15/53

(52) U.S. Cl. ..... 428/375; 428/378; 428/394; 252/8.81; 252/8.84

(58) Field of Search ..... 428/375, 378, 428/392, 394; 252/8.81, 8.84

(56) References Cited

U.S. PATENT DOCUMENTS

| | | | | | |
|---|---|---|---|---|---|
| 1,681,745 | A | | 8/1928 | Pohl | 106/268 |
| 2,876,140 | A | | 3/1959 | Sheehan | 117/139.5 |
| 3,704,160 | A | | 11/1972 | Steinmiller | 117/138.8 |
| 3,770,861 | A | | 11/1973 | Hirano et al. | 264/130 |
| 3,888,775 | A | * | 6/1975 | Koizumi et al. | 252/8.8 |
| 4,066,558 | A | | 1/1978 | Shay et al. | 252/8.9 |
| 4,076,631 | A | | 2/1978 | Caruso et al. | 252/8.8 |
| 4,144,026 | A | | 3/1979 | Keller et al. | 8/115.6 |
| 4,153,561 | A | | 5/1979 | Hummuller et al. | 252/8.75 |
| 4,190,545 | A | * | 2/1980 | Marshall et al. | 252/8.75 |
| 4,192,754 | A | * | 3/1980 | Marshall et al. | 252/8.8 |
| 4,264,484 | A | | 4/1981 | Patel | 260/29.6 |
| 4,283,292 | A | * | 8/1981 | Marshall et al. | 252/8.8 |
| 4,329,390 | A | | 5/1982 | Danner | 428/264 |
| 4,388,372 | A | | 6/1983 | Champaneria et al. | 428/395 |
| 4,401,780 | A | | 8/1983 | Steel | 524/225 |
| 4,504,401 | A | | 3/1985 | Matsuo et al. | 252/8.75 |
| 4,565,717 | A | | 1/1986 | Hosegood et al. | 427/339 |
| 4,566,981 | A | | 1/1986 | Howells | 252/8.8 |
| 4,680,212 | A | | 7/1987 | Blyth et al. | 428/97 |
| 4,702,741 | A | * | 10/1987 | Dexheimer | 8/115.6 |
| 4,822,373 | A | | 4/1989 | Olson et al. | 8/115.6 |
| 4,833,188 | A | | 5/1989 | Kortmann et al. | 524/217 |
| 4,839,212 | A | | 6/1989 | Blyth et al. | 428/96 |
| 4,875,901 | A | | 10/1989 | Payet et al. | 8/115.56 |
| 4,883,604 | A | * | 11/1989 | Veitenhansl et al. | 252/8.9 |
| 4,900,496 | A | | 2/1990 | Andrews, Jr. et al. | 264/103 |
| 4,925,707 | A | | 5/1990 | Vinod | 427/393.4 |
| 4,940,757 | A | | 7/1990 | Moss, III et al. | 525/502 |
| 4,959,248 | A | | 9/1990 | Oxenrider et al. | 427/385.5 |
| 5,015,259 | A | | 5/1991 | Moss, III et al. | 8/115.6 |
| 5,025,052 | A | | 6/1991 | Crater et al. | 524/104 |
| 5,057,121 | A | | 10/1991 | Fitzgerald et al. | 8/133 |
| 5,061,763 | A | | 10/1991 | Moss, III et al. | 525/502 |
| 5,073,442 | A | | 12/1991 | Knowlton et al. | 428/267 |
| 5,084,306 | A | | 1/1992 | McLellan et al. | 427/339.4 |
| 5,139,873 | A | | 8/1992 | Rebouillat | 428/375 |
| 5,153,046 | A | | 10/1992 | Murphy | 428/96 |
| 5,240,743 | A | | 8/1993 | Tuller et al. | 427/384 |
| 5,244,951 | A | | 9/1993 | Gardiner | 524/168 |
| 5,246,988 | A | | 9/1993 | Wincklhofer et al. | 524/86 |
| 5,252,232 | A | | 10/1993 | Vinod | 252/8.6 |
| 5,260,406 | A | | 11/1993 | Pechhold | 528/158 |
| 5,263,308 | A | | 11/1993 | Lee et al. | 57/241 |
| 5,310,828 | A | | 5/1994 | Williams | 252/502 |
| 5,370,804 | A | | 12/1994 | Day | 252/41 |
| 5,399,616 | A | | 3/1995 | Kuhn et al. | 524/765 |
| 5,408,010 | A | | 4/1995 | May | 252/327.4 |
| 5,414,111 | A | | 5/1995 | Kirchner | 560/357 |
| 5,464,911 | A | | 11/1995 | Williams et al. | 525/502 |
| 5,491,004 | A | | 2/1996 | Mudge et al. | 427/393.4 |
| 5,516,337 | A | | 5/1996 | Nguyen | 8/557 |
| 5,520,962 | A | | 5/1996 | Jones, Jr. | 427/393 |
| 5,565,607 | A | | 10/1996 | Maekawa et al. | 560/223 |
| 5,567,400 | A | | 10/1996 | Mudge et al. | 252/8.62 |
| 5,599,613 | A | | 2/1997 | Smith | 252/8.62 |
| 5,654,086 | A | | 8/1997 | Nishijima et al. | 442/199 |
| 5,683,612 | A | * | 11/1997 | Birnbriche et al. | 252/8.84 |
| 5,688,759 | A | | 11/1997 | Behler et al. | 510/526 |
| 5,738,687 | A | | 4/1998 | Kamrath et al. | 8/115.56 |
| 5,756,181 | A | | 5/1998 | Wang et al. | 428/96 |
| 5,916,474 | A | * | 6/1999 | Fijii et al. | 252/8.81 |
| 5,942,176 | A | * | 8/1999 | Fujii et al. | 264/130 |
| 6,197,378 | B1 | * | 3/2001 | Clark et al. | 427/315 |
| 6,204,353 | B1 | * | 3/2001 | Eicken et al. | 528/295.3 |

FOREIGN PATENT DOCUMENTS

| | | | | |
|---|---|---|---|---|
| DE | 296515 | | 10/1983 | D06M/13/224 |
| DE | 260405 | * | 9/1988 | D01F/11/04 |
| DE | 197 50 246 A1 | | 5/1999 | |

(List continued on next page.)

OTHER PUBLICATIONS

Printout of REGISTRY database entry for registry No. 9004–99–3 (polyoxyethylene stearate).*
International Search Report for PCT/US99/10368.
Melliand Textilberichte—International Textile Reports English Edition vol. 6 No. 3 Mar., 1977 p. 250–209.
Goulston Technologies, Inc. Specialists In Fiber Lubricants *Lubricants For Synthetic Fibers* Jul. 24, 1998.
*Lubricants For Fiber and Yarn Production* http://www.gem-san.com/english/textile–lubricants_for_fiber_and_yarn_pr.htm.

(List continued on next page.)

*Primary Examiner*—Cheryl A. Juska

(57) ABSTRACT

A soil-resistant spin finish composition based on select derivitized polyethers is provided that can be applied to a fiber at the earliest stages of spinning, can remain on the fiber through the entire manufacturing process, and can be left on the fiber in the final article of commerce. The spin finish composition provides excellent fiber lubrication during high-speed spin processing, yet is sufficiently soil resistant to negate the need for scouring the final fiber construction, even absent the presence of additional coatings or agents.

48 Claims, No Drawings

FOREIGN PATENT DOCUMENTS

| | | | | |
|---|---|---|---|---|
| EP | 0 112 496 | | 7/1984 | |
| EP | 0 353 080 | | 7/1989 | ..... D06M/15/277 |
| EP | 539790 | * | 5/1993 | ..... C07C/309/17 |
| EP | 0 547 846 A1 | | 6/1993 | |
| EP | 0 638 635 A1 | | 3/1994 | ..... C11D/1/825 |
| EP | 0 696 661 A1 | | 2/1995 | ..... D06M/11/38 |
| EP | 0 921 216 A1 | | 6/1999 | |
| EP | 0 943 724 A1 | | 9/1999 | |
| FR | 2.034.379 | | 12/1970 | |
| FR | 2 235 963 | | 1/1975 | |
| GB | 930336 | | 7/1963 | |
| GB | 1189581 | | 4/1970 | ..... D05C/17/02 |
| JP | 2572503 | | 5/1967 | ..... D06M/13/10 |
| JP | 59-066575 | * | 4/1981 | ..... D06M/13/32 |
| JP | 58-180685 | * | 10/1983 | ..... D06M/13/32 |
| JP | 59-130373 | * | 7/1984 | ..... D06M/13/02 |
| JP | 62-243875 | * | 10/1987 | ..... D06M/13/224 |
| JP | 62-243876 | * | 10/1987 | ..... D06M/13/224 |
| JP | 05-044115 | * | 2/1993 | ..... D01F/11/04 |
| JP | 6057541 | | 3/1994 | ..... D01F/11/08 |
| JP | 7252727 | | 10/1995 | ..... D01F/11/08 |
| JP | 9049167 | | 2/1997 | ..... D06M/13/292 |
| WO | WO 91/04305 | | 4/1991 | ..... C09K/13/18 |
| WO | WO 92/10605 | | 6/1992 | ..... D06M/15/263 |
| WO | WO 93/15255 | | 8/1993 | |
| WO | WO 93/19238 | | 9/1993 | ..... D06M/15/41 |
| WO | WO 96/06824 | | 3/1996 | |
| WO | WO 97/00350 | | 1/1997 | |
| WO | WO 97/06127 | | 2/1997 | ..... C07C/69/653 |
| WO | WO 98/04772 | | 2/1998 | |
| WO | WO 98/27263 | | 6/1998 | |

OTHER PUBLICATIONS

*Spin Finishes For Synthetic Fibres–Part IV* Dr. N.B. Nevrekar & B.H. Palan, Sasmira.

Goulston Technologies, Inc. Specialists In Fiber Lubricants *Applying Spin Finishes For Optimum Downstream Fiber Quality* Aug. 18, 1998 http://www.onlinetextilenews.com/news/90345854915850.htm.

* cited by examiner

SOIL-RESISTANT SPIN FINISH COMPOSITIONS

FIELD OF THE INVENTION

This invention relates to soil-resistant spin finish compositions, a method for applying the compositions to synthetic fibers, and final fiber constructions made from synthetic fibers treated with the soil-resistant spin finish compositions.

BACKGROUND OF THE INVENTION

Lubrication and finishing of yarns and threads, such as cotton and silk, has been practiced since ancient times. Such yarns and threads, derived from natural-occurring plants and animals such as cotton plants and silkworms, often required lubrication or finishing by "oiling" or "sizing" to facilitate spinning and bundling. Lubricants used were typically natural hydrophobic oils, such as mineral oil or coconut oil. Sometimes, molten waxes such as beeswax were employed which, when cooled, formed a solid lubricating finish. Usually, the fibers were "sized" by applying a lubricant and/or adhesive material to yarn or warp threads in a weaving operation to impart cohesion and lubricity. Historically, sizes have been hard coatings, applied neat and at a higher fiber add-on than spin finishes, and were often based on starch, wax, and other oleophilic materials. For example, U.S. Pat. No. 1,681,745 discloses a beeswax-based size for artificial silk (rayon) which is applied molten and solidifies quickly before the thread is wound up, thus assuring bundle cohesion and lubrication in all subsequent operations.

While sizes were useful in facilitating the spinning and bundling of fibers, their presence in finished articles was found to be undesirable. In particular, the oleophilic nature of the sizes was found to adversely effect the soil resistance of the finished article. Sizes also frequently compromised the appearance and handle of the article Consequently, it became common practice to remove the size from a woven article after its manufacture by scouring the article in hot and/or detergent-containing water. In some instances, these sizes were also removed or reduced to acceptable levels as an inherent part of the dying process, as when the woven article is dyed through immersion in aqueous dye baths. However, this later methodology, in which the scouring and dying steps were effectively combined into a single process, also had its drawbacks. In particular, the presence of sizes in the dye bath frequently had adverse affects on the dying process, while also necessitating frequent replenishment of the dye solution.

After World War II, fibers were introduced which were made from synthetic polymers such as nylon, polyolefin, polyester and acrylic. These new high performance synthetic fibers required the use of special sizes called "spin finishes" during spinning and the subsequent fiber operations (e.g., bundling or sizing) required to produce the final woven article (e.g., fabric or carpet). The spin finish served several functions, including (1) reducing the friction developed as the synthetic fibers passed over metal and ceramic machinery surfaces, (2) imparting fiber-to-fiber lubricity, (3) minimizing electrical static charge buildup (a problem especially pronounced in the manufacture of woven articles from synthetic fibers), and, in some instances, (4) providing cohesion to the fiber. In addition, with proper use of additives, spin finish compositions could be made that were stable to high temperatures and pressures, had a controllable viscosity under application conditions, were non-corrosive, and were relatively safe to both the workers and the environment. (See Pushpa, B. et al., "Spin Finishes," *Colourage,* Nov. 16–30, 1987 (17–26)). However, as with their sizing predecessors, the spin finishes had to be removed from the articles woven from the fibers, typically by scouring, to minimize soiling problems See, e g., U.S. Pat. No. 5,263,308 (Lee et al.), Col. 2, Lines 23–25.

The process of scouring is very undesirable in that it is a tedious process which adds to manufacturing costs, while also posing water pollution problems and health concerns. See, e.g., U.S. Pat. No. 5,263,308 (Lee et al.), Col. 2, Lines 20–24. Accordingly, some attempts have been made to avoid the need for scouring by treating unscoured carpets with agents that improve the soil resistance, handle, and other characteristics of the unscoured carpet to levels acceptable for the intended end use. Thus, U.S. Pat. No. 5,756,181 (Wang et al.) and U.S. Pat. No. 5,738,687 (Kamrath et al.) describe the treatment of unscoured carpet with certain polycarboxylate salts to achieve desirable soil resistance and repellency characteristics. Similarly, U.S. Ser. No. 08/595,592 (Wang et al.) describes the topical treatment of unscoured carpets with various inorganic agents such as silica to improve the soil resistance of the carpet. However, while these treatments are notable improvements in the art and work quite well in certain end uses, the requirement of a polycarboxylate salt and/or an inorganic additive is not desirable for all applications.

Other methods have been proposed in the art that are aimed at removing soil-attracting fiber finishes while avoiding the need for scouring and, in some cases, the need for additional treatment agents However, most of these methods have proven impractical in a commercial setting. For instance, Japanese Patent 2,572,503 describes a polyether oil spin finish that is sublimed or decomposed from spun-out yarn by heating the treated yarn to 180–220° C. Unfortunately, the high temperatures required for this process have an adverse effect on the yarn, and the sublimation process itself is undesirable because of the energy and pollution problems attendant thereto. Accordingly, it remains the conventional practice in the art to remove spin finishes by scouring.

Most spin finishes currently known to the art are aqueous emulsions or dispersions, although some neat spin finishes are also known. The former are frequently preferred to neat spin finishes because the larger volume of finish applied per fiber weight results in lower application variability. Additionally, the water helps eliminate troublesome static charge, especially when formulated with other additives. (See Postman, W., "Spin Finishes Explained," *Textile Research Journal,* July 1980 (444–453). Also, aqueous emulsions and dispersions frequently have lower viscosities, and therefore better frictional properties, than neat systems, and are easier to remove by scouring or during the dyeing process. See, e.g., R. J. Crossfield, "Applying Spin Finishes for Optimum Downstream Fiber Quality" (Aug. 18, 1998), and R. J. Crossfield, "Lubricants for Synthetic Fibers" (Jul. 24, 1998), both publications of Goulston Technologies, Inc.

The patent literature describes the use of a wide variety of aqueous emulsions or dispersions as components of various fiber treatments or finishes. These materials are typically removed by scouring with hot water and/or detergent, or by other methods (e.g., as an inherent part of immersion dying) to avoid the detrimental affect of the finish on the soiling properties of the final article of commerce.

U.S. Pat. No. 4,388,372 (Champaneria et al.) describes an improved process for making soil-resistant filaments of a synthetic linear polycarbonamide, preferably 6-nylon and 66-nylon, by applying a water-borne primary spin finish composition comprising a perfluoroalkyl ester, a modified epoxy resin and a non-ionic textile lubricant based on poly(ethylene glycol). Particularly preferred lubricants include n-butyl initiated random copolymers of ethylene/propylene oxide. At Col. 6, Lines 59–61 of the reference, it is noted that "Excessive amounts of textile lubricants in the finish composition can interfere in the durability and effectiveness of the soil-resistant ingredients." Accordingly, much of the lubricant is removed at a later stage of processing when the filaments are subjected to a scouring or dyeing operation (Col. 6, lines 51–55), and application of a secondary fiber finish composition to the spun yarn is recommended at the point between the take up and windup rolls (Col. 12, lines 18–19).

U.S. Pat. No. 5,139,873 (Rebouillat) discloses aromatic polyamide fibers which are said to be highly processable and to have high modulus, improved surface frictional properties, scourability, deposition, fibrillation and antistatic properties. The fibers have a coating consisting of (a) 30–70% by weight of a long chain carboxylic acid ester of a long chain branched primary or secondary, saturated, monohydric alcohol, (b) 20 to 50% by weight of an emulsifying system consisting of certain nonionic surfactants, with the remainder being an antistatic agent, a corrosion inhibitor or other optional additives. The scourability of the coating is said to be very important as the residual finish level impacts the subsequent finishing in the case of fabrics (Col. 11, Lines 52–56).

U.S. Pat. No. 5,263,308 (Lee et al.) describes a method for ply-twisting nylon yarns (already spun) at high speeds by coating the nylon fibers with less than about 1% by weight of a finish containing an alkyl polyoxyethylene carboxylate ester lubricant composition of the general formula $R_1$—O—$X_n$—$(CH_2)_m$C(O)—O—$R_2$, where $R_1$ is an alkyl chain from 12 to 22 carbon atoms, X is —$C_2H_4O$— or a mixture of —$C_2H_4O$— and —$C_3H_6O$—, n is 3 to 7, m is 1 to 3, and $R_2$ is an alkyl chain from 1 to 3 carbon atoms. The resulting ply-twisted yarn is especially suitable for use as pile in carpets. The reference notes that these lubricants are advantageous over other lubricants in that they may be applied at very low levels and afford ease of wash-off during dying or scouring operations, both of which lead to improved soiling repellency (see Col. 5, Lines 10–36).

On class of materials that has found applicability in the fiber finish art are polyoxyalkylenes. These materials have been used as minor components in various fiber finish formulations and, in some instances, have also been used as secondary spin finishes.

British Patent Specification 1,189,581 describes a process for treating dyed or undyed cellulose-esters or synthetic fibers or yarns, or mixtures thereof, to improve their lubrication against polished metal machine parts and to change the physical characteristics of the fibers or yarns so as to facilitate weaving. Compounds used to treat the fibers or yarns include compounds of the general formula $R_1$C(O)O—Y—$R_2$, where $R_1$ is a straight or branched chain hydrocarbon residue containing from 5 to 17 carbon atoms, $R_2$ is a short chain hydrocarbon residue containing 1 or 2 carbon atoms, and Y is a polyglycol residue containing from 3 to 16 alkylene oxide groups with 2 or 3 carbon atoms in the alkylene chain. The ability to remove the compound by washing (i.e., scouring) is required for possible later dying operations.

U.S. Pat. No. 5,246,988 (Wincklhofer et al.) describes the use of lubricants, which are the reaction product of 1 mole of either a $C_5$–$C_{36}$ fatty acid or alcohol with 2 to 20 moles of ethylene oxide, as carriers for hindered amine anti-oxidants. These anti-oxidants/carriers are used to treat articles of high molecular weight thermoplastic films and fibers, thereby rendering the articles stable to heat and aging and allowing them to retain their breaking strength. Preferably, the lubricant comprises polyalkylene glycol (400) perlargonate, polyalkylene glycol (200) monolaurate and/or polyalkylene glycol (600) monoisostearate.

U.S. Pat. No. 3,770,861 (Hirano et al.) describes compositions of the formula $R_1$—C(O)—O—A—C(O)—$R_2$, $R_1$—O—A—C(O)—$R_2$ and $R_1$—O—A—H, wherein $R_1$ and $R_2$ are each alkyl, aralkyl or alkaryl groups of 2–26 carbon atoms, and wherein A can be $(CH_2CH_2O)_n$, where n is an integer not less than 1. These compositions are used as melt-adhesion preventors for the super-drawing of melt-spinnable polyester fibers.

U.S. Pat. No. 5,399,616 (Kuhn et al.) describes lubricant-containing aqueous preparations obtained by polymerizing a monomer mixture of an ethylenically unsaturated carboxylic acid, a sulfonated aliphatic or aromatic monovinyl compound and an N-substituted vinyl amide in the presence of a polyol which has been esterified with a fatty acid of 8 to 26 carbon atoms. The preparation comprises 70–95% monomer mixture and 5–30% esterified polyol. The preparations are used as a low friction additive in dyeing and textile auxiliaries and, in particular, to prevent crease marks during textile wet processing. No mention is made of fiber lubricants or soil-resistant properties.

U.S. Pat. No. 5,491,004 (Mudge et al.) describes a method for applying a low soil finish to textile fibers as a secondary finish, i.e., a finish applied subsequent to fiber spinning. This method comprises applying to the spun fibers a low soil finish composition containing a dry, waxy solid component which can comprise the reaction product of a $C_8$–$C_{22}$ fatty acid ester with from 2 to 250 moles of ethylene oxide. Treated fibers and fabrics and carpets made therefrom are claimed to exhibit excellent soil-resistance. However, since this fatty acid ester composition is recommended when a cleanable, i.e., removable, low soil fiber finish is desired (Col. 3, Lines 22–27), the reference does not address the more difficult challenge of developing a low soiling primary finish.

Research Disclosures 16949 and 19520, "New Finishes," May 1978 and July 1980, disclose finishes useful for treating industrial fibers, such as polyamide and aramide fibers and yarns. These finishes can contain up to 40 parts (per hundred) of polyethylene glycol (400–600) monostearate and 15 parts of polyethylene glycol distearate and are apparently applied as secondary finishes.

U.S. Pat. No. 4,883,604 (Veitenhansl et al.) describes compositions and methods for smoothing textile fibers and sheet-form textiles made from the fibers. These compositions, which are described as solutions, emulsions, or aqueous dispersions, contain a combination of aliphatic polyether having $C_6$–$C_{24}$ alkyl radicals and containing 1 to 25 units of polymerized $C_2$–$C_6$ alkylene oxides and oxidized, high-density polyethylene. The concentration of aliphatic polyether in these compositions is from 5% to 30%, with the remainder of the composition being dispersants, softeners, other additives, and water. The compositions are used to improve stitching characteristics of the sheet-formed textiles, and no mention is made of improving soil-resistance or repellency.

Other references of note include U.S. Pat. No. 5,153,046 (Murphy), which describes an aqueous finish composition for imparting soil-resistant protection to textile fibers, e.g., nylon yarn. The composition is said to be stable to the high shear environment of a fiber finish application system. This composition is composed of 1–35% (weight) of nonionic fluorochemical textile anti-soilant, 65–95% of nonionic water-soluble or water-emulsifiable lubricant, and 0.05–15% each of quaternary ammonium or protonated amine surfactant and nonionic surfactant. Preferred lubricants are polyethylene glycol 600 monolaurate and methoxypolyethylene glycol 400 monopelargonate.

A new proprietary spin finish composition for use with nylon and polypropylene fibers has been marketed by the George A. Goulston Co. (Monroe, N.C.) under the trade designation NF-5338. Although this spin finish composition, which is believed to be primarily composed of alkylated polyethylene glycol having more than 13 ethylene oxide units (i.e., having a PEG molecular weight of at least 600), is described as "soil resistant", it does not exhibit the level of soil-resistance required for many applications.

While the finishes described in the above noted references have certain advantageous features, most of these finishes are either secondary spin finishes, or are not spin finishes at all. Hence, these references do not address the more strenuous requirements of a primary spin finish. Moreover, these references do not disclose a method for providing a primary spin finish to fibers which avoids the need for scouring.

Accordingly, there still exists a need in the art for a spin finish composition which can be applied to a fiber at the earliest stages of spinning, which can remain on the fiber all the way through the final fiber construction (typically carpet), which will enhance, or at least not compromise, the soil-resistant and repellency performance of the final fiber construction, and which does not require the use of other agents (e.g., inorganic additives or polycarboxylate salts) to exhibit desirable soil resistance properties. These and other needs are met by the current invention, as hereinafter described.

SUMMARY OF THE INVENTION

In one aspect, the present invention relates to a soil-resistant spin finish composition and a method of using the same. The spin finish composition can be applied to a fiber at the earliest stages of spinning, can remain on the fiber through the entire manufacturing process, and can be left on the fiber in the final article of commerce. The spin finish composition provides excellent fiber lubrication during high-speed spin processing, yet is sufficiently soil resistant to negate the need for scouring the final fiber construction, even absent the presence of additional coatings or agents.

The spin finish composition of the present invention comprises at least about 35% by weight of spin finish solids comprising a derivatized polyether selected from the group consisting of Formula I and Formula II:

$$R^1A—(R^2O)_nR^2—B—R^3 \quad \text{(Formula I)}$$

$$G[(R^4O)_a—R^4—D—R^5]_t \quad \text{(Formula II)}$$

wherein:

$R^1$ is an alkyl group or alkaryl group containing at least 13 carbon atoms, and preferably is a saturated alkyl group containing between 17 to 21 carbon atoms, inclusive;

$R^2$ is $—C_2H_4—$, $—C_3H_6—$ or $—C_4H_8—$ or, when adjacent to a —C(O)— moiety of A or B, can be $—CH_2—$;

$R^3$ is hydrogen or is an alkyl group containing between 1 and 22 carbon atoms inclusive;

$R^4$ is either $—C_2H_4—$, $—C_3H_6—$ or $C_4H_8—$ or, when adjacent to a —C(O)— moiety of D, can be $—CH_2—$;

$R^5$ is an alkyl group containing at least 13 carbon atoms, and preferably is a saturated alkyl group containing between 16 and 21 carbon atoms, inclusive;

A is independently selected from the group consisting of —C(O)O—, OC(O)—, —C(O)NH—, —NHC(O)—, —O—, —NHC(O)O—, —OC(O)NH— and —NHC(O)NH—, and is preferably —C(O)O—;

B is independently selected from the group consisting of —OC(O)—, C(O)O—, —NHC(O)—, —C(O)NH—, —OC(O)NH— and —NHC(O)NH—, and is preferably OC(O)—; and n is between 1 and 20, and preferably between 4 and 10; with the proviso that, when $R^3$ is hydrogen, B is —O— (i.e., forming an alcohol group), and with the additional proviso that, when A is —C(O)O— and B is —OC(O)—, n is between 1 and 12;

G is the residue from a polyfunctional nucleophilic initiating species, such as from pentaerythritol, trimethylolpropane or glycerol;

D is selected from the group consisting of —C(O)O—, —OC(O)—, —C(O)N—, —NHC(O)—, —NHC(O)O—, —OC(O)NH— and —NHC(O)NH—, and is preferably —OC(O)—;

a is at least 1; and b is either 3 or 4 and may comprise at least 73% by weight, based on the total weight of solids in the spin finish, of said polyether. The spin finish may also comprise less than about 10% by weight, based on the total weight of spin finish solids, of fluorochemical, and less than about 1% by weight, based on the total weight of spin finish solids, of an antistat. The antistat may be, for example, polyethylene glycol lauryl phosphoric acid. The spin finish may also comprise less than about 1% by weight, based on the total weight of spin finish solids, of an emulsifier, such as, for example, sodium dodecylbenzene sulfonate.

DETAILED DESCRIPTION OF THE PREFERRED EMBODIMENTS

As used herein, the term "primary spin finish" refers to a spin finish which is applied to synthetic fibers soon after they are extruded from the spinneret, cooled, and bundled, but prior to drawing.

Thermoplastic polymers useful for making synthetic fibers of this invention include fiber-forming poly(alpha) olefins, polyamides, polyesters and acrylics. Preferred thermoplastic polymers are poly (alpha)olefins, including the normally solid, homo-, co- and terpolymers of aliphatic mono-1-olefins (alpha olefins) as they are generally recognized in the art. Usually, the monomers employed in making such poly(alpha)olefins contain 2 to 10 carbon atoms per molecule, although higher molecular weight monomers sometimes are used as comonomers. Blends of the polymers and copolymers prepared mechanically or in situ may also be used. Examples of monomers that can be employed in the invention include ethylene, propylene, butene-1, pentene-1, 4-methyl-pentene-1, hexene-1, and octene-1, alone, or in admixture, or in sequential polymerization systems. Examples of preferred thermoplastic poly(alpha)olefin polymers include polyethylene, polypropylene, propylene/ethylene copolymers, polybutylene and blends thereof. Polypropylene is particularly preferred for use in the invention.

Processes for preparing the polymers useful in this invention are well known, and the invention is not limited to a polymer made with a particular catalyst or process.

In accordance with the present invention, a molten thermoplastic polymer fiber can be extruded through a spinneret to form a plurality of filaments (typically around 80 filaments), each filament typically having a delta-shaped cross section. The filaments are cooled, typically by passing through an air quenching apparatus maintained at or slightly below room temperature. The filaments are then bundled and directed across guides or kiss rolls, whereupon they are treated with a molten spin finish of this invention. After receiving the spin finish treatment, the filaments are generally stretched. Stretching may be accomplished over a number of godets or pull rolls that are at elevated temperatures (e.g., from 85–115° C.) sufficient to soften the thermoplastic polymer. By rotating the rolls at different speeds, stretching of the filaments can be obtained. While stretching can be accomplished in one step, it may be desirable to stretch the filaments in two steps. Typically, the filaments will be stretched 3 to 4 times the extruded length (i.e., stretched at a ratio of from 3:1 to 4:1). Subsequent to stretching, and in order to obtain a carpet yarn, it is desirable to texture the yarn with pressured air at an elevated temperature (e.g., 135° C.) or steam jet and to subject it to crimping or texturizing.

Spin finishes can be applied to fibers at different stages of the production process, depending upon what balance of performance properties are demanded from the fiber at that particular production stage. A primary spin finish is generally applied to the fibers soon after they are extruded from the spinneret, cooled, and bundled, but prior to drawing, texturizing or crimping the fiber. The primary spin finish reduces fiber-to-metal or fiber-to-ceramic friction while the fiber travels along the early stage production equipment.

Application of a secondary spin finish is often necessary during the later stage production (i.e., after stretching, crimping and texturizing of the fiber). Weaving often requires higher bundle cohesion than can be tolerated during spinning of staple fibers. The secondary spin finish imparts greater adhesion and friction to the yarn or rope made from the yarn.

While ideally the primary spin finish would have properties which eliminate the need for any secondary spin finish, this is not always possible. For example, during production, fiber-to-metal or fiber-to-ceramic friction should be low, but the final article (rope, for example) may benefit from higher friction. A primary spin finish must be optimized to allow the initial stages of yarn production to proceed in an efficient manner. If the succeeding stages have different requirements, a secondary finish will have to be applied. A secondary finish will also have to be applied if the primary spin finish is removed, or almost removed, during a processing step. For example, the majority of primary spin finish is removed during dyeing of yarn or cloth in aqueous dyeing baths. Examples of these considerations abound in the cited literature.

Derivatized polyethers suitable for use in the soil-resistant spin finish compositions of the present invention include those given by the formula $C_nH_{2n+1}C(O)O(C_2H_4O)_kC_mH_{2m}OC(O)C_nH_{2n+1}$, wherein k is between 1 and 20, m is between about 1 and about 22, and n is at least 13 as well as the following compounds:

$C_{17}H_{35}C(O)O(C_2H_4O)_{3.5}C_2H_4OC(O)C_{17}H_{35}$ $C_{17}H_{35}C(O)O(C_2H_4O)_6C_2H_4OC(O)C_{17}H_{35}$ $C_{17}H_{35}C(O)O(C_2H_4O)_8C_2H_4OC(O)C_{17}H_{35}$ $C_{17}H_{35}C(O)O(C_2H_4O)_8C_2H_4OH$ $C_{17}H_{35}C(O)O(C_2H_4O)_7C_2H_4OCH_3$ $C_{21}H_{43}C(O)O(C_2H_4O)_8C_2H_4OC(O)C_{21}H_{43}$ $C_{17}H_{35}C(O)O(C_3H_6O)_2C_3H_6OCH_3$ $C_{17}H_{35}C(O)O(C_3H_6O)_2C_3H_6OC_4H_9$ $C_{17}H_{35}C(O)O(C_3H_6O)_2C_3H_6OC(O)C_{17}H_{35}$ $C_{15}H_{31}C(O)O(C_2H_4O)_8C_2H_4OC(O)C_{15}H_{31}$ $C_{13}H_{27}C(O)O(C_2H_4O)_8C_2H_4OC(G)C_{13}H_{27}$ $C_{21}H_{43}C(O)O(C_2H_4O)_8C_2H_4OC(O)C_{21}H_{43}$ $C_{18}H_{37}O(C_2H_4O)_8C_2H_4OC(O)C_{17}H_{35}$ $C_8H_{17}C_6H_4O(C_2H_4O)_8C_2H_4OC(O)C_{17}H_{35}$ $C_{18}H_{37}OC(O)CH_2O(C_2H_4O)_4CH_2C(O)OC_{18}H_{37}$ $C_{17}H_{35}C(O)NHC_3H_6O(C_2H_4O)_{11}C_3H_6NHC(O)C_{17}H_{35}$ $CH_3O(C_2H_4O)_{12}C_3H_6NHC(O)C_{17}H_{35}$ $C_{17}H_{35}NHC(O)CH_2O(C_2H_4O)_4CH_2C(O)NHC_{17}H_{35}$ $C_{18}H_{37}NHC(O)O(C_2H_4O)_7C_2H_4OCH_3$ $C_{18}H_{37}NHC(O)O(C_3H_6O)_6C_3H_6OC(O)NHC_{18}H_{37}$ $C_{17}H_{35}C(O)O(C_2H_4O)_4CH_2—C—[CH_2O(C_2H_4O)_4C(O)C_{17}H_{35}]_3$ $CH_3CH_2C—[CH_2O(C_2H_4O)_2C(O)C_{17}H_{35}]_3$

These polyethers may be blended with sufficient carrier (water and/or solvent) to provide a fluid spin finish composition which can be applied to fibers using conventional spin finish application equipment, at levels within the range of about 0.2% SOF (weight per cent solids on fiber) to about 4% SOF, more preferably from about 0.5% SOF to about 2% SOF, and most preferably from about 0.75% SOF to about 1.4% SOF. Water is preferred as the major component of the carrier. Suitable solvents which can be used alone or in combination with water include acetates (e.g., ethyl acetate), alcohols (e.g., ethanol) and glycol ethers (e.g., propylene glycol monopropyl ether).

The following optional additives may also be incorporated into an aqueous dispersion containing the soil-resistant spin finish composition of the present invention (percentages are given as weight percent solids of the spin finish)

(a) a fluorochemical repellent (typically up to 20%), (b) an antistat (typically up to 5%), and (c) an emulsifier (typically up to 1%).

Examples of useful fluorochemical repellents include fluorochemical urethanes, ureas, biurets, isocyanurates, carbodiimides, allophanates, esters, guanidines, oxazolidinones, acrylate polymers, ethers, alcohols, epoxides, amides, amines (and salts thereof) and acids (and salts thereof). These fluorochemical repellents are generally oligomers or polymers containing rod-like pendant fluorochemical groups which orient in a comb-like structure at the air interface to provide water, oil and soil repellency. The pendant fluorochemical groups are generally of the structure $C_nF_{2n+1}[QN(R')]_a(CH_2)_b$—, wherein n is an integer from 4 to 12, Q is either —C(O)— or —$SO_2$—, R' is H or an alkyl group having from 1 to four carbon atoms, a is either 1 (present) or 0 (absent), and b is an integer from 1 to 12. The fluorochemical repellent should be incorporated in the spin finish composition at a sufficient level to provide oil and/or water repellency to the finished fiber, i.e., providing at least about 0.01% SOF, and preferably at least about 0.02% SOF.

Examples of useful antistats and emulsifiers are described by W. Postman in "Spin Finishes Explained," *Textile Research Journal* July 1980 (444–453).

Derivatized Polyethets—Preparation, Sources

PEG400MS (polyethylene glycol 400 monostearate)—100 g (0.25 mol) of CARBOWAX™ 400 diol (commercially available from Union Carbide Corp., Danbury, Conn.) was combined with 71 g (0.25 mol) of stearic acid in 400 g of toluene in a 3-necked flask equipped with stirrer, heating mantle, thermometer and condenser. The contents were heated, azeotroped dry using a Dean Stark trap, and were allowed to cool. Next, 1.0 g (0 5% by weight of solids) of p-toluene sulfonic acid was added, and the mixture was refluxed with stirring overnight with the continuous removal of water. Infrared analysis indicated no acid carbonyl remained. A solution of 0.5 g of NaHCO3 in deionized water was then added. The resulting two-phase system was stirred and the water and toluene were removed at 80° C. using a ROTO-VAC™ evaporator to produce the desired monoester, $C_{17}H_{35}C(O)O(C_2H_4O)_8C_2H_4OH$. This monostearate and its constituent reactants are presented as the first entry in TABLE 1.

The following esterified polyethers, also listed in TABLE 1, were made using essentially the same procedure as described for polyethylene glycol 400 monostearate, except (1) the CARBOWAX™ 400 glycol was replaced by CARBOWAX™ glycols or CARBOWAX™ monomethyl ether alcohols (MPEG) having polyethylene glycol (PEG) segments of varying molecular weights, or the CARBOWAX™ 400 glycol was replaced by tripropylene glycol (TPG), its methyl ether alcohol (MTPG) or butyl ether alcohol (BuTPG) and/or (2) the stearic acid was replaced by another carboxylic acid such as behenic acid, palmitic acid or myristic acid at the desired mole ratio All raw materials used in TABLE 1 are commercially available from Aldrich/Sigma Chemical Co., Milwaukee, Wis.

TABLE 1

| Abbreviation Used | Chemical Structure of Esterified Polyether | Polyether (moles): | Carboxylic Acid (moles): |
|---|---|---|---|
| PEG400MS | $C_{17}H_{35}C(O)O(C_2H_4O)_8C_2H_4OH$ | PEG 400 (1) | stearic acid (1) |
| PEG200DS | $C_{17}H_{35}C(O)O(C_2H_4O)_{35}C_2H_4OC(O)C_{17}H_{35}$ | PEG 200 (1) | stearic acid (2) |
| PEG300DS | $C_{17}H_{35}C(O)O(C_2H_4O)_6C_2H_4OC(O)C_{17}H_{35}$ | PEG 300 (1) | stearic acid (3) |
| PEG400DS | $C_{17}H_{35}C(O)O(C_2H_4O)_8C_2H_4OC(O)C_{17}H_{35}$ | PEG 400 (1) | stearic acid (2) |
| PEG600DS | $C_{17}H_{35}C(O)O(C_2H_4O)_{13}C_2H_4OC(O)C_{17}H_{35}$ | PEG 600 (1) | stearic acid (2) |
| PEG900DS | $C_{17}H_{35}C(O)O(C_2H_4O)_{19}C_2H_4OC(O)C_{17}H_{35}$ | PEG 900 (1) | stearic acid (2) |
| PEG1500DS | $C_{17}H_{35}C(O)O(C_2H_4O)_{33}C_2H_4OC(O)C_{17}H_{35}$ | PEG 1500 (1) | stearic acid (2) |
| PEG2000DS | $C_{17}H_{35}C(O)O(C_2H_4O)_{44}C_2H_4OC(O)C_{17}H_{35}$ | PEG 2000 (1) | stearic acid (2) |
| PEG400DB | $C_{21}H_{43}C(O)O(C_2H_4O)_8C_2H_4OC(O)C_{21}H_{43}$ | PEG 400 (1) | behenic acid (2) |
| PEG600DB | $C_{21}H_{43}C(O)O(C_2H_4O)_{13}C_2H_4OC(O)C_{21}H_{43}$ | PEG 600 (1) | behenic acid (2) |
| PEG1500DB | $C_{21}H_{43}C(O)O(C_2H_4O)_{33}C_2H_4OC(O)C_{21}H_{43}$ | PEG 1500 (1) | behenic acid (2) |
| PEG2000DB | $C_{21}H_{43}C(O)O(C_2H_4O)_{44}C_2H_4OC(O)C_{21}H_{43}$ | PEG 2000 (1) | behenic acid (2) |
| MPEG350MS | $C_{17}H_{35}C(O)O(C_2H_4O)_7C_2H_4OCH_3$ | MPEG 350 (1) | stearic acid (1) |
| MPEG500MS | $C_{17}H_{35}C(O)O(C_2H_4O)_{12}C_2H_4OCH_3$ | MPEG 550 (1) | stearic acid (1) |
| MPEG750MS | $C_{17}H_{35}C(O)O(C_2H_4O)_{16}C_2H_4OCH_3$ | MPEG 750 (1) | stearic acid (1) |
| MPEG2000MS | $C_{17}H_{35}C(O)O(C_2H_4O)_{44}C_2H_4OCH_3$ | MPEG 2000 (1) | stearic acid (1) |
| MPEG5000MS | $C_{17}H_{35}C(O)O(C_2H_4O)_{113}C_2H_4OCH_3$ | MPEG 5000 (1) | stearic acid (1) |
| PEG400DP | $C_{15}H_{31}C(O)O(C_2H_4O)_8C_2H_4OC(O)C_{15}H_{31}$ | PEG 400 (1) | palmitic acid (2) |
| PEG400DM | $C_{13}H_{27}C(O)O(C_2H_4O)_8C_2H_4OC(O)C_{13}H_{27}$ | PEG 400 (1) | myristic acid (2) |
| MTPGMS | $C_{17}H_{35}C(O)O(C_3H_6O)_2C_3H_6OCH_3$ | MTPG (1) | stearic acid (1) |
| BuTPGMS | $C_{17}H_{35}C(O)O(C_3H_6O)_2C_3H_6OC_4H_9$ | BuTPG (1) | stearic acid (1) |
| TPGDS | $C_{17}H_{35}C(O)O(C_3H_6O)_2C_3H_6OC(O)C_{17}H_{35}$ | TPG (1) | stearic acid (1) |

TP-70TS (Trimethylolpropane Triethoxylate TP-70 tristearate)—To a 3-necked round-bottom flask equipped with stirrer, heating mantle and thermometer was added 50 g (0.1146 mol) of Trimethylolpropane Triethoxylate TP-70 (ave. $M_n$ 430) (commercially available from Perstorp Polyols, Perstorp, Sweden), 97.9 g (0.344 mol) of stearic acid, 150 g of toluene and 1% by weight of total solids of $CH_3SO_3H$. This mixture was heated to reflux for 15 hours using a Dean-Stark apparatus. Next, 1% by weight of $Ca(OH)_2$ was added to the mixture and the precipitate formed was filtered hot. The toluene was removed under vacuum using a ROTO-VAC™ evaporator. The remaining solid showed no —OH peak by infrared analysis, indicating the reaction had progressed to completion to form the desired product, $C_2H_5—C[CH_2O(CH_2CH_2O)_nC(O)C_{17}H_{35}]_3$.

PP-150TS (Pentaerythritol Tetraethoxylate PP-150 tetrastearate)—To a 3-necked round-bottom flask equipped with stirrer, heating mantle and thermometer was added 50 g (0.0625 mol) of Pentaerythritol Tetraethoxylate PP-150 (ave. $M_n$ 800) (commercially available from Perstorp Polyols), 71.1 g (0.25 mol) of stearic acid, 150 g of toluene and 1% by weight of total solids of $CH_3SO_3H$. This mixture was heated to reflux for 15 hours using a Dean-Stark apparatus. Next, 1% by weight of $Ca(OH)_2$ was added to the mixture and the precipitate formed was filtered hot. The toluene was removed under vacuum using a ROTO-VAC™ evaporator. The remaining solid showed no —OH peak by infrared analysis, indicating the reaction had progressed to completion to give the desired product, $C—[CH_2O(CH_2CH_2O)_4]_4C(O)C_{17}H_{35}$.

ED-600DSA (JEFFAMINE™ ED-600 distearamide)—To a 3-necked round-bottom flask equipped with stirrer, heating mantle and thermometer were added 100 g (0.1666 mol) of JEFFAMINE™ ED-600 polyoxyethylene diamine (commercially available from Huntsman Chemical Co., Houston, Tex.), 47.4 g (0.3332 mol) of stearic acid, and 0.15 g (0.1 wt %) of IRGANOX™ 1010 antioxidant (commercially available from Ciba-Geigy Corp., Greensboro, N.C.). The mixture was heated at 150° C. under nitrogen for 2–3 hours, followed by heating at 180–200° C. for an additional 7–8 hours. Infrared spectroscopy of this material showed an —NH peak at 3305 $cm^{-1}$ with the disappearance of —COOH and no primary amine peaks, confirming the formation of the distearamide, $C_{17}H_{35}C(O)NHCH(CH_3)CH_2O(CH_2CH_2O)_{12}CH_2CH(CH_3)NHC(O)C_{17}H_{35}$.

ED-900DSA (JEFFAMINE™ ED-600 distearamide)—This composition was prepared using essentially the same procedure as was described for preparing ED-600DSA, except that JEFFAMINE™ ED-900 polyoxyethylene diamine (commercially available from Huntsman Chemical Co.) was substituted for JEFFAMINE™ ED-600 polyoxyethylene diamine.

M-715MSA (JEFFAMINE™ M-715 monostearamide)—This composition was prepared using essentially the same procedure as was described for preparing ED-600DSA, except that JEFFAMINE™ M-715 methoxypolyoxyethylene monoamine (commercially available from Huntsman Chemical Co.) was substituted for JEFFAMINE™ ED-600 polyoxyethylene diamine and the monostearamide, $CH_3O(CH_2CH_2O)_{15}CH_2CH(CH_3)NHC(O)C_{17}H_{35}$, was made instead of the distearamide.

PEG400DSU (polyethylene glycol 400 distearyl urethane)—To a 3-necked flask equipped with stirrer, heating mantle and thermometer were added 30.5 g (0.0762 mol) of CARBOWAX™ 400 diol and 150 ml of toluene. The mixture was refluxed for 2–3 hours using a Dean-Stark apparatus. Some water (<0.3 mL) was collected in Dean-Stark condenser and discarded. After cooling this mixture to 70° C., 45.05 g (0.1524 mol) of octadecyl isocyanate (commercially available from Aldrich/Sigma Chemical Co.) and 1 drop of dibutyltin dilaurate catalyst were added, and the mixture was stirred at 70° C. for 12 hours under nitrogen. Infrared spectral analysis of the reaction product showed an —NH peak at 3334 $cm^{-1}$ with the disappearance of —NCO peak, confirming the formation of the distearyl urethane, $C_{18}H_{37}NHC(O)O(CH_2CH_2O)_8C(O)NHC_{18}H_{37}$. The toluene was evaporated under vacuum using a ROTO-VAC™ evaporator.

PPG425DSU (polypropylene glycol 425 distearyl urethane)—To a 3-necked round-bottom flask equipped with stirrer, heating mantle and thermometer were added 50 g (0.0118 mol) of polypropylene glycol (number average mol. wt. of 525, commercially available from Sigma/Aldrich Chemical Co., Milwaukee, Wis.), 69.5 g (0.235 mol) of octadecyl isocyanate, 150 g of ethyl acetate and 2 drops of dibutyltin dilaurate catalyst. The mixture was heated at 75° C. for 12 hours under nitrogen. IR analysis of this material showed a —NH peak at 3334 $cm^{-1}$ with the disappearance of —NCO peak confirming the formation of the distearyl urethane, $C_{18}H_{37}NHC(O)O[CH_2CH(CH_3)O]_9C(O)NHC_{18}H_{37}$. The ethyl acetate was evaporated under vacuum using a ROTO-VAC™ evaporator.

MPEG350MSU (methoxypolyethylene glycol 350 monostearyl urethane)—To a 2-necked, 1-L round bottom flask equipped with magnetic stirring bar, condenser and thermometer was added 100 g (0.286 mol) of MPEG350 and 84.4 g (0.286 mol) of octadecyl isocyanate (both commercially available from Aldrich/Sigma Chemical Co., Milwaukee, Wis.), 350 g of toluene and 2–3 drops of dibutyltin dilaurate. The mixture was heated to 55–60° C. and was stirred gently for 8 hours. At this time, IR analysis showed total reaction of the isocyanate groups. The toluene was then stripped off and the urethane, $CH_3O(C_2H_4O)_8C(O)N(H)C_{18}H_{37}$, was isolated.

MPEG750MSU (methoxypolyethylene glycol 750 monostearyl urethane)—This composition was prepared using essentially the same procedure as was described for preparing MPEG350MSU, except that MPEG 750 methoxypolyoxyethylene alcohol was substituted for NPEG 350 methoxypolyoxyethylene alcohol.

MPEG2000MSU (methoxypolyethylene glycol 2000 monostearyl urethane)—This composition was prepared using essentially the same procedure as was described for preparing MPEG350MSU, except that MPEG 2000 methoxypolyoxyethylene alcohol was substituted for MPEG 350 methoxypolyoxyethylene alcohol.

NF-5338 Spin Finish Composition—NF-5338 is a low-soiling spin finish formulation, commercially available from George A. Goulston Co., Monroe, N.C., believed to be primarily composed alkylated polyethylene glycol having more than 13 ethylene oxide units (i.e., having a PEG molecular weight of at least 600).

L-1D Carpet—carpet made from polypropylene fiber having coated thereon approximately 0.74% SOF of spin finish having the following composition (w/w): 10% PEG400DS, 1.4% MeFOSE600UU, 0.1% ETHFAC™ 142W antistat (available from Ethox Chemicals, Greenville, S.C.) and the remainder being ethyl acetate.

SSC 6-789A—a commercial spin finish (available from SSC Industries, East Point, Ga.), believed to be a monoester of a 7-unit polyethylene oxide and lauric acid.

Fluorochemical Repellent Additives—Preparation, Sources

FX-1373M—3M Brand FX-1373M Commercial Carpet Protector, commercially available from 3M Company, St. Paul, Minn.

FX-1860—SCOTCHGARD™ FX-1860 Fabric Protector, commercially available from 3M Company FC-365—3M Brand FC-365 Carpet Protector, commercially available from 3M Company FC-248—SCOTCHGARD™ FC-248 Stain Release, commercially available from 3M Company EtFOSE600U—a fluorochemical polyoxyethylene urethane synthesized and emulsified according to the following process. Into a 3-necked flask equipped with an overhead stirrer, thermometer and reflux condenser with nitrogen inlet were placed 114 g (0.2 mole) of DESMODUR™ N-100 triisocyanate (commercially available from Miles Corp., Pittsburgh, Pa.), 205 g (0.37 mol) of EtFOSE alcohol ($C_8F_{17}SO_2N(C_2H_5)C_2H_4OH$, commercially available from 3M Company as FLUORAD™ FC-10 fluorochemical alcohol), 200 g of methyl isobutyl ketone (MIBK) and 5 drops of dibutyltin dilaurate catalyst. The resulting mixture was heated to 80° C. and was allowed to react overnight to complete the reaction. Then 75.6 g (0.126 mol) of CARBOWAX™ 600 glycol (commercially available from Union Carbide Corp.) was added, the temperature was maintained at 80° C., and the reaction was allowed to proceed until no free isocyanate was detectable by infrared spectroscopy, indicating that all isocyanate groups had been converted to urethane groups. Next, 166 g of the resulting polymer solution was mixed with 104 g of MIBK, and this mixture was emulsified in 400 g of deionized water containing 4% (w/w) of SIPONATE™ DS-10 (sodium dodecylbenzene sulfonate, commercially available from Rhone-Poulenc, North America Chem., Surfactants & Specialties, Cranberry, N.J.) using a Branson SONIFIER™ 450 ultrasonic horn (commercially available from VWR Scientific, West Chester, Pa.). The MIBK was removed under reduced pressure to yield an aqueous polymer dispersion containing approximately 25% fluorochemical solids EtFOSE1450U—a fluorochemical polyoxyethylene urethane, synthesized and emulsified using the same procedure as described for the preparation of EtFOSE600U, except that an equimolar quantity of CARBOWAX™ 1450 glycol (commercially available from Union Carbide Corp.) was substituted for the CARPBOWAX™ 600 glycol.

EtFOSE600UU—a fluorochemical polyoxyethylene urethane urea, synthesized using the following process. Into a 3-necked flask equipped with an overhead stirrer, thermometer and reflux condenser with nitrogen inlet were placed 114 g (0.2 mole) of DESMODUR™ N-100 triisocyanate (commercially available from Miles Corp., Pittsburgh, Pa.), 183 g (0.33 mol) of $C_8F_{17}SO_2N(C_2H_5)C_2H_4OH$ (commercially available from 3M Company as FLUORAD™ FC-10 fluorochemical alcohol), 200 g of methyl isobutyl ketone (MIBK) and 5 drops of dibutyltin dilaurate catalyst. The resulting mixture was heated to 80° C. for 6 hours to complete the urethane reaction. Next, 1.35 g (0.075 mol) of deionized water was added, and the reaction mixture was allowed to react overnight at 80° C. to complete the urea reaction. Finally, 45 g (0.075 mol) of CARBOWAX™ 600 glycol (commercially available from Union Carbide Corp.) was added, the temperature was maintained at 80° C., and the reaction was allowed to proceed until no free isocyanate was detectable by infrared spectroscopy, indicating that all isocyanate groups had been converted to urethane groups. A 25% solids (wt) emulsion was prepared using the same procedure earlier described for preparing the EtFOSE600 emulsion.

EtFOSE1450UU—a fluorochemical polyoxyethylene urethane, synthesized and emulsified using the same procedure as described for the preparation of EtFOSE600UU, except that an equimolar quantity of CARBOWAX™ 1450 glycol was substituted for the CARBOWAX™ 600 glycol.

MeFOSE600UU—a fluorochemical polyoxyethylene urethane, synthesized and emulsified using the same procedure as described for the preparation of EtFOSE600UU, except that an equimolar quantity of MeFOSE alcohol ($C_8F_{17}SO_2N(CH_3)C_2H_4OH$, available from 3M Company) was substituted for the MeFOSE alcohol.

MeFOSE1450UU—a fluorochemical polyoxyethylene urethane, synthesized and emulsified using the same procedure as described for the preparation of MeFOSE600UU, except that an equimolar quantity of CARBOWAX™ 1450 glycol was substituted for the CARBOWAX™ 600 glycol.

PEG400DS/MeFOSE1450UU Emulsion—prepared as follows.

First, a PEG400DS emulsion was prepared as follows. 200 g of PEG400DS was heated in an oven to 70° C. to a molten state. In a separate bottle, 10 g of RHODACAL™ DS-10 (available from Rhone Poulenc, Cranbury, N.J.) was dissolved in 1190 g of deionized water, and the resulting aqueous solution was heated to 70° C. The molten PEG400DS was placed in a stainless steel beaker, stirred vigorously, and the aqueous solution was added. With continued stirring, a sufficient amount of 20% (w/w) aqueous NaOH was added to bring the pH up to around 6.0. The resulting mixture was then hydrogenized for 20 minutes using a BRANSON™ Sonifier Ultrasonic Horn (available from VWR Scientific). The translucent emulsion produced was transferred to a polyethylene bottle, which was capped and rolled on a jar mill until cooled to around room temperature. The resulting PEG400DS emulsion was 15.2% (w/w) solids.

Next, MeFOSE1450UU was prepared as described in the synthesis of Fluorochemical Treatment E in U.S. Pat. No 5,672,651, except that the weight ratio used of MeFOSE fluorochemical alcohol to CARBOWAX™ 1450 glycol to DESMODUR™ N-100 isocyanate was 39.0:38.3:22.7 and ethyl acetate was used as the solvent rather than methyl isobutyl ketone. The resulting 30% (w/w) fluorochemical polyoxyethylene urethane urea solution in ethyl acetate was heated to 70° C. Meanwhile, an aqueous solution consisting of 14.9 g RHODACAL™ DS-10 in 550 g of deionized water was also pre-heated to 70° C. The ethyl acetate solution was placed in a stainless steel beaker, stirred vigorously, and to it was added the aqueous solution. Using a 20% (w/w) aqueous NaOH solution, the pH of the resulting mixture was adjusted to 6 and the mixture was homogenized for 10 minutes using a BRANSON™ Sonifier Ultrasonic Horn. The emulsion that formed was then placed in a 2 L round bottom flask and was vacuum stripped at 60° C., resulting in a 17.7% (w/w) solids emulsion of MeFOSE1450UU.

To make the PEG400DS/MeFOSE1450UU emulsion, the above-described PEG400DS and MeFOSE1450UU emulsions were mixed at a 7.7:1 (v/v) ratio and the mixture was diluted with deionized water to give an emulsion containing 10% (w/w) PEG400DS and 1.5% (w/w) MeFOSE1450UU.

P250Telomer—a fluorochemical polyoxyethylene diester, prepared as follows. To a 3-necked round bottom flask equipped with stirrer, heating mantle and thermometer was added 25 g (0.1 mol) of polyethylene glycol bis-carboxymethyl methyl ether (ave. mol. wt. of 250, available from Sigma Aldrich, Milwaukee, Wis.), 102.8 g (0.2 mol) of Zonyl™ BA-N alcohol (available from E. I. duPont de Nemours, Wilmington, Del.), 150 g of toluene and 1% by weight on solids of p-toluenesulfonic acid. The resulting mixture was heated to reflux for 15 hours using a Dean Stark apparatus. Next, 1% by weight on solids of $Ca(OH)_2$ was added to the mixture and the precipitate formed was removed by filtration when still hot. Toluene was removed from the filtrate using a ROTO-VAC™ evaporator. The remaining solid showed no —OH peak by infrared analysis, indicating the reaction had progressed to completion to form the desired product, $F(CF_2)_nCH_2CH_2OC(O)CH_2O(CH_2CH_2O)_mCH_2C(O)OCH_2CH_2(CF_2)_nF$.

P250MeFOSE—a fluorochemical polyoxyethylene diester, prepared using essentially the same procedure as was described for preparing P250Telomer except that $C_8F_{17}SO_2N(CH_3)CH_2CH_2OH$ (MeFOSE alcohol) was substituted for Zonyl™ BA-N alcohol.

FOSE linoleate—To a 3-necked round-bottom flask equipped with stirrer, heating mantle and thermometer was added 200 g (0.359 mol) of MeFOSE alcohol, 100 g (0.359 mol) of linoleic acid (available from Eastman Fine Chemicals, Rochester, N.Y.), 150 g of toluene and 1% by weight on solids of p-toluenesulfonic acid. The resulting mixture was heated to reflux for 15 hours using a Dean Stark apparatus. Next, 1% by weight on solids of $Ca(OH)_2$ was added to the mixture and the precipitate formed was removed by filtration when still hot. Toluene was removed from the filtrate using a ROTO-VAC™ evaporator. The remaining solid showed no —OH peak by infrared analysis, indicating the reaction had progressed to completion to form the desired product, $C_8F_{17}SO_2N(CH_3)CH_2CH_2OC(O)(CH_2)_7CH{=}CHCH_2CH{=}CH(CH_2)_4CH_3$.

FC adipate—a fluorochemical ester prepared as described in U.S. Pat. No. 4,264,484, Example 8, Formula XVII.

FC oxazolidinone—a fluorochemical oxazolidinone prepared by using essentially the same procedure as described in Scheme I of U.S. Pat. No. 5,025,052 (Crater et al.), reacting $C_8F_{17}SO_2N(CH_3)CH(OH)CH_2Cl$ with stearyl isocyanate at a 1:1 molar ratio followed by ring closure.

Test Methods

Fiber Spinning Procedure—Polypropylene resin having a melt-flow index of approximately 17 was melt-spun in the conventional manner through a spinneret at a rate of 91 g/min to provide 80 filaments with a delta-shaped cross-section. The molten filaments were then passed across an air quenching apparatus maintained at 60° F. (15° C.) whereupon solidification of the filaments occurred. The solid filaments were collected into a fibers which were directed across a slotted ceramic guide, where primary spin finish was applied by pump at a level of 0.75% solids on fiber (SOF). From the spin finish ceramic guide, the treated fiber traveled over a turnabout to the first godet. The fiber was wrapped 6 times around the first godet, said godet being heated to 85° C. From the first godet, the fiber traveled to the second godet, where it was wrapped 6 times. The second godet was maintained at 115° C. and its speed was adjusted to three times that of the first godet, thus drawing the fiber at a ratio of 3:1. From the second godet, the fiber traveled to a conventional hot air texturizer set at 135° C. and 7 bar (700,000 Pa) pressure to form a yarn. The yarn then traveled to a third godet set at room temperature (i.e., about 25° C.), where it was wrapped 6 times, and finally to a conventional winder. Fiber denier of the drawn and texturized fiber was maintained at approximately 1450 denier by adjustment of polymer output at the spinneret.

Coefficient of Friction Measurement—When measurement of coefficient of friction was desired, the yarn from the texturizer was wound 6 times around a fourth godet, across the tension transducer, across the friction pin, across the second tension transducer, 6 times around another godet and onto the winder.

At a given line speed, the apparent coefficient of friction (COF) between the fiber and the metal friction pin can be calculated using the following "capstan" equation:

$$COF=\ln(T_1/T_0)/q$$

where $T_1$ is the tension on the fiber just before the metal friction pin, $T_0$ is the tension on the fiber just after the metal friction pin, and q is the angle of contact in radians between the fiber and the metal friction pin. For all examples, $T_0$ was standardized at 200 g and q was standardized at 3.002 radians (corresponding to the 25.4 mm diameter pin used). For all examples, the line speed was maintained at about 270 m/min.

The tension measurements were made using two Rothschild Permatens™ measuring heads obtained from Lawson-Hemphill, Inc., Central Falls, R.I. Using a realtime data aquisition computer, the tension readings were recorded for each run at one second intervals over a 40-second time period.

A COF value of 0.30 or less is considered desirable, although COF values above 0.30 may be acceptable.

Determining Percent Lubricant on Fiber—The % SOF of spin finish composition actually coated onto the fiber was determined in accordance with the following test procedure.

An 8 g sample of spin finish-coated fiber is placed in an 8 oz (225 mL) glass jar along with 80 g of solvent (typically ethyl acetate or methanol). The glass jar is capped and placed on a roller mill for 10 minutes. Next, 50 g of the solvent containing the stripped lubricant is removed and is poured into a tared aluminum pan which is placed in a 250° F. (121° C.) vented oven for 20 minutes to evaporate the solvent. The pan is then reweighed to determine the amount of lubricant present, using the following calculations:

$$\%\ SOF=(\text{grams of finish extracted})/(5\text{ grams})\times 100$$

Carpet Tufting Procedure—Samples of texturized fiber (i.e., yarn) were tufted into a level-loop style carpet at 5/32 guage, 12 stitches per inch (5 stitches per centimeter) and 0.25 inch (0.64 cm) pile height.

Non-scoured (NS) control carpet was prepared from woven fiber treated with SSC 6-789A spin finish at approximately 0.75% SOF.

Scoured (S) control carpet was prepared from the non-scoured control carpet by continuously rotating the carpet through a Beck style hot water bath to remove the commercial spin finish, followed by spin extraction and drying.

"Walk-On" Soiling Test—The relative soiling potential of carpet tufted from texturized fiber was determined by challenging both treated and untreated (control) carpet samples under defined "walk-on" soiling test conditions and comparing their relative soiling levels. The test is conducted by mounting treated and untreated carpet squares on particle board, placing the samples on the floor of one of two chosen commercial locations, and allowing the samples to be soiled by normal foot traffic. The amount of foot traffic in each of these areas is monitored, and the position of each sample within a given location is changed daily using a pattern designed to minimize the effects of position and orientation upon soiling.

Following a specific soil challenge period, measured in number of cycles where one cycles equals approximately 10,000 foot-traffics, the treated samples are removed and the amount of soil present on a given sample is determined using calorimetric measurements. This method of measurement assumes that the amount of soil on a given sample is directly proportional to the difference in color between the unsoiled sample and the corresponding sample after soiling. The three CIE L*a*b* color coordinates of the unsoiled and subsequently soiled samples are measured using a Minolta 310 Chroma Meter with a D65 illumination source. The color difference value, ΔE, is calculated using the equation shown below:

$$\Delta E=[(\Delta L^*)^2+(\Delta a^*)^2+(\Delta b^*)^2]^{1/2}$$

where:

ΔL*=L*soiled−L*unsoiled

Δa*=a*soiled−a*unsoiled

Δb*=b*soiled−b*unsoiled

ΔE values calculated from these calorimetric measurements (usually an average of six replicates) are qualitatively in agreement with values from older, visual evaluations, such as the soiling evaluation suggested by the AATCC. These ΔE values have the additional advantages of higher precision, being unaffected by evaluation environment or subjective operator differences. Generally, the number of cycles is chosen so that the ΔE value for the soiled scoured carpet is around 3–4. A ΔE value for unscoured carpet of no greater than 6 is considered desirable.

A ΔΔE value can be readily calculated by subtracting the ΔE value of soiled scoured carpet from the ΔE value of soiled, spin finish-treated carpet. The ΔΔE value is especially useful as it represents a direct comparison of soiling between spin finish-treated carpet and scoured carpet. Though ΔΔE values can vary significantly depending upon carpet color and soiling conditions (e.g., winter vs. summer), a ΔΔE value of no greater than about 3 is considered desirable.

Water Repellency Test—Carpet tufted from texturized fiber was evaluated for water repellency using 3M Water Repellency Test V for Floor coverings (February 1994), available from 3M Company. In this test, a carpet sample is challenged to penetrations by blends of deionized water and isopropyl alcohol (IPA). Each blend is assigned a rating number as shown below:

| Water Repellency Rating Number | Water/IPA Blend (% by volume) |
|---|---|
| F | (fails water) |
| 0 | 100% water |
| 1 | 90/10 water/IPA |
| 2 | 80/20 water/IPA |
| 3 | 70/30 water/IPA |
| 4 | 60/40 water/IPA |
| 5 | 50/50 water/IPA |
| 6 | 40/60 water/IPA |

-continued

| Water Repellency Rating Number | Water/IPA Blend (% by volume) |
|---|---|
| 7 | 30/70 water/IPA |
| 8 | 20/80 water/IPA |
| 9 | 10/90 water/IPA |
| 10 | 100% IPA |

In running the Water Repellency Test, a treated carpet sample is placed on a flat, horizontal surface and the carpet pile is hand-brushed in the direction giving the greatest lay to the yarn. Five small drops of water or a water/IPA mixture are gently placed at points at least two inches apart on the carpet sample. If, after observing for ten seconds at a 45° angle, four of the five drops are visible as a sphere or a hemisphere, the carpet is deemed to pass the test. The reported water repellency rating corresponds to the highest numbered water or water/IPA mixture for which the treated carpet sample passes the described test.

A water repellency value of at least 0, preferably at least 2 or higher, is considered desirable.

Oil Repellency Test—Carpet tufted from texturized fibers was evaluated for oil repellency using 3M Oil Repellency Test III (February 1994), available from 3M Company, St. Paul, Minn. In this test, a treated carpet sample is challenged to penetration by oil or oil mixtures of varying surface tensions. Oils and oil mixtures are given a rating corresponding to the following:

| Oil Repellency Rating Number | Oil Composition |
|---|---|
| F | (fails mineral oil) |
| 1 | mineral oil |
| 1.5 | 85/15 (vol) mineral oil/ n-hexadecane |
| 2 | 65/35 (vol) mineral oil/n-hexadecane |
| 3 | n-hexadecane |
| 4 | n-tetradecane |
| 5 | n-dodecane |
| 6 | n-decane |

The Oil Repellency Test is run in the same manner as is the Water Repellency Test, with the reported oil repellency rating corresponding to the highest oil or oil mixture for which the treated carpet sample passes the test.

An oil repellency value of at least 1.5, preferably at least 2 or higher, is considered desirable.

EXAMPLES

Examples 1–3 and Comparative Examples C1–C6

In EXAMPLES 1–3 and COMPARATIVE EXAMPLES C1–C4, various polyoxyethylene distearates were evaluated as soil-resistant materials in spin finish compositions. Each distearate was dissolved at 10% (w/w) in ethyl acetate to make a fluid spin finish composition. Then, using the Fiber Spinning Procedure, each spin finish composition was applied to 1450 denier polypropylene fiber at a level of approximately 0.75% SOF distearate.

In COMPARATIVE EXAMPLE C5, a commercial proprietary spin finish composition, SSC 6-789A, was diluted to 10% (w/w) solids in ethyl acetate, and the resulting solution was applied to 1450 denier polypropylene fiber at a level of approximately 0.75% SOF.

COF values were also measured during each spin finish application. Each resulting texturized fiber was tufted into a level-loop style carpet using the Carpet Tufting Procedure.

In COMPARATIVE EXAMPLE C6, the level-loop style polypropylene carpet made as described in COMPARATIVE EXAMPLE C5 was scoured as described in the carpet tufting section to remove the spin finish.

Each carpet was then evaluated for soil-resistance (AAE) using the "Walk-On" Soiling Test.

Results are presented in TABLE 2.

TABLE 2

| EXAMPLE | Spin Finish | COF | ΔΔE |
|---|---|---|---|
| 1 | PEG200DS | 0.45* | 0.2 |
| 2 | PEG300DS | 0.29 | 0.6 |
| 3 | PEG400DS | 0.27 | 0.8 |
| C1 | PEG600DS | 0.26 | 2.6 |
| C2 | PEG900DS | 0.28 | 3.0 |
| C3 | PEG1500DS | 0.29 | 2.8 |
| C4 | PEG2000DS | 0.29 | 3.7 |
| C5 | SSC 6-789A | 0.28 | 4.9 |
| C6 | Scoured | N/A | 0 |

*This COF value can be decreased to as low as 0.20 by applying higher SOF levels of PEG200DS to the fiber The data in TABLE 2 show that all polyoxyethylene distearate spin finish compositions tested imparted good COF values. The carpets treated with spin finish compositions containing polyethylene oxide blocks of molecular weight of 400 or less exhibited soil-resistant properties comparable to those of the scoured carpet. PEG200DS imparted exceptional anti-soiling properties, comparable to scoured carpet.

Example 4 and Comparative Examples C7–C11

In EXAMPLE 4 and COMPARATIVE EXAMPLES C7–C11, various polyoxyethylene dibehenates were evaluated as soil-resistant materials in spin finish compositions. Each dibehenate was dissolved at 10% (w/w) in ethyl acetate to make a fluid spin finish composition. Using the Fiber Spinning Procedure, each spin finish composition was applied to 1450 denier polypropylene fiber to give a level of approximately 0.75% SOF dibehenate.

In COMPARATIVE EXAMPLE C10, the same commercial spin finish experiment was run as described in COMPARATIVE EXAMPLE C5.

During spin finish application, COF values were measured for each experiment. Each resulting texturized fiber was tufted into a level-loop style carpet using the Carpet Tufting Procedure. Each resulting carpet was then evaluated for soil-resistance (ΔΔE) using the "Walk-On" Soiling Test.

In COMPARATIVE EXAMPLE C11, the same comparative experiment was run as in COMPARATIVE EXAMPLE C6 (scoured carpet control).

Results are presented in TABLE 3.

TABLE 3

| EXAMPLE | Spin Finish | COF | ΔΔE |
|---|---|---|---|
| 4 | PEG400DB | 0.25 | 1.0 |
| C7 | PEG600DB | 0.25 | 2.4 |
| C8 | PEG1500DB | 0.26 | 3.9 |
| C9 | PEG2000DB | 0.28 | 3.9 |

TABLE 3-continued

| EXAMPLE | Spin Finish | COF | ΔΔE |
|---|---|---|---|
| C10 | SSC 6-789A | 0.28 | 4.7 |
| C11 | Scoured | N/A | 0 |

The data in TABLE 3 show that all polyoxyethylene dibehenate spin finish compositions imparted good COF values. The carpet treated with the spin finish composition containing the polyethylene oxide block having a molecular weight of 400 exhibited soil-resistant properties approximating that of the scoured carpet.

Example 6 and Comparative Examples C12–C17

(Example 5 was Deleted from Application)

In EXAMPLE 6 and COMPARATIVE EXAMPLES C12–C17, various polyoxyethylene monostearates were evaluated as soil-resistant materials in spin finish compositions. Each monostearate was dissolved at 10% (w/w) in ethyl acetate to make a fluid spin finish composition Using the Fiber Spinning Procedure, each spin finish composition was applied to 1450 denier polypropylene fiber to give a level of approximately 0.75% SOF monostearate.

In COMPARATIVE EXAMPLE C16, the same commercial spin finish experiment was run as in COMPARATIVE EXAMPLE C5.

During spin finish application, COF values were measured for each experiment. Each resulting texturized fiber was tufted into a level-loop style carpet using the Carpet Tufting Procedure. Each resulting carpet was then evaluated for soil-resistance (ΔΔE) using the "Walk-On" Soiling Test.

In COMPARATIVE EXAMPLE C17, the same experiment was run as in COMPARATIVE EXAMPLE C6 (scoured carpet control).

Results are presented in TABLE 4.

TABLE 4

| EXAMPLE | Spin Finish | COF | ΔΔE |
|---|---|---|---|
| 6 | MPEG350MS | 0.25 | 0.9 |
| C12 | MPEG550MS | 0.25 | 3.4 |
| C13 | MPEG750MS | 0.26 | 4.0 |
| C14 | MPEG2000MS | 0.29 | 3.3 |
| C15 | MPEG5000MS | 0.24 | 2.8 |
| C16 | SSC 6-789A | 0.28 | 5.3 |
| C17 | scoured | N/A | 0 |

The data in TABLE 4 show that all polyoxyethylene monostearate spin finish compositions imparted good COF values. The carpet treated with the MPEG350MS spin finish composition exhibited soil-resistant properties comparable to that of the scoured carpet.

Examples 7–22 and Comparative Example C18

In EXAMPLES 7–21, a spin finish composition containing various fluorochemicals and PEG400DS dissolved in ethyl acetate was applied to 1450 denier polypropylene fiber using the Fiber Spinning Procedure. The % SOF of spin finish and the fluorochemical level (the latter expressed as ppm fluorine) on the fiber were determined experimentally and are listed in TABLE 5.

In EXAMPLE 22, the same experiment was run as in EXAMPLES 6–18 except that the fluorochemical was omitted.

During spin finish application, COF values were measured for each experiment. Each resulting texturized fiber was tufted into a level-loop style carpet using the Carpet Tufting Procedure. Each resulting carpet was then evaluated for water repellency (WR) and oil repellency (OR) using the Water Repellency Test and the oil Repellency Test. Each resulting carpet was also evaluated for soil-resistance (ΔΔE) using the "Walk-On" Soiling Test.

In COMPARATIVE EXAMPLE C18, the same experiment was run as in COMPARATIVE EXAMPLE C6 (scoured carpet control).

Results are presented in TABLE 5.

TABLE 5

| Ex. | % SOF | Name | Type | ppm F | COF | WR | OR | ΔΔE |
|---|---|---|---|---|---|---|---|---|
| 7 | N/R* | FX-1373M | urethane | 348 | 0.44 | 9 | 6 | N/R* |
| 8 | 0.41 | FX-1860 | urethane | 234 | 0.34 | 6 | 6 | −0.6 |
| 9 | 0.67 | FC-365 | allophanate | 380 | 0.34 | 2 | 2 | −0.4 |
| 10 | 0.78 | FC-248 | acrylate polymer | 200 | 0.31 | 1 | 5 | −0.4 |
| 11 | 0.87 | EtFOSE600U | urethane | 324 | 0.31 | 4 | 6 | 0.1 |
| 12 | 0.59 | EtFOSE1450U | urethane | 258 | 0.32 | 3 | 6 | −0.6 |
| 13 | 0.64 | EtFOSE600UU | urethane-urea | 326 | 0.31 | 4 | 6 | −0.3 |
| 14 | 0.60 | EtFOSE1450UU | urethane-urea | 243 | 0.34 | 5 | 5 | −1.0 |
| 15 | 0.57 | MeFOSE600UU | urethane-urea | 293 | 0.35 | 9 | 6 | −0.7 |
| 16 | N/R* | MeFOSE1450UU | urethane-urea | 267 | 0.36 | 10 | 6 | −0.6 |
| 17 | 0.56 | P250MeFOSE | ester | 390 | 0.30 | 1 | 5 | −0.7 |
| 18 | 0.56 | P250Telomer | ester | 515 | 0.29 | 1 | 2 | 0 |
| 19 | N/R* | FC Adipate | ester | 318 | 0.34 | 1 | 1.5 | −0.9 |
| 20 | 0.52 | FOSE Linolenate | ester | 442 | 0.28 | 1 | 0 | −0.1 |
| 21 | 0.45 | FC Oxazolidinone | oxazolidinone | 343 | 0.29 | 1 | 0 | 2.8 |
| 22 | 0.45 | — | — | 26 | 0.25 | 0 | 0 | 0.3 |
| C18 | — | scoured | — | — | — | 0 | F | 0 |

*N/R means not recorded

The data in TABLE 5 show that a spin finish composition based on PEG400DS and containing certain fluorochemicals, especially fluorochemical urethanes and urethane-ureas, greatly improved both the oil and water repellency, improved soil-resistance (comparable to or slightly better than scoured carpet), and generally maintained coefficient of friction values.

Examples 23–28 and Comparative Example C19

In EXAMPLES 23–26, various polyoxypropylene esters were dissolved at 10% (w/w) in ethyl acetate. Using the Fiber Spinning Procedure, these spin finish compositions were applied to 1450 denier polypropylene fiber to give a level of approximately 0.75% SOF ester.

In EXAMPLES 27–28, the same experiments were run as in EXAMPLES 23–26, except the derivatized polyethers evaluated were polyoxyethylene amides.

In COMPARATIVE EXAMPLE C19, the same commercial spin finish experiment was run as in COMPARATIVE EXAMPLE C5.

During spin finish application, COF values were measured for each experiment. Each resulting texturized fiber was tufted into a level-loop style carpet using the Carpet Tufting Procedure. Each resulting carpet was then evaluated for soil-resistance (ΔE) using the "Walk-On" Soiling Test.

Results are presented in TABLE 6.

TABLE 6

| EXAMPLE | Spin Finish | COF | ΔE |
|---|---|---|---|
| 23 | MTPGMS | 0.56 | 2.9 |
| 24 | BuTPGMS | 0.55 | 3.3 |
| 25 | TPGDS | 0.54 | 3.4 |
| 26 | PPG400D-DS | 0.32 | 5.1 |
| 27 | ED-600DSA | 0.31 | 5.5 |
| 28 | ED-900DSA | 0.26 | 8.6 |
| C19 | SSC 6-789A | — | 8.9 |

The data in TABLE 6 show that polyoxypropylene esters imparted good COF values, though not as low as the polyoxyethylene materials evaluated in TABLES 2–5. All candidates exhibited good soil-resistant behavior. Polyoxyethylene amides showed lower coefficient of friction values but somewhat worse soil-resistant performance, with the ED900DSA exhibiting soil-resistant behavior comparable to that of the unscoured control.

Examples 29–37 and Comparative Examples C20–C24

In this series of examples, various possible modifications of the derivatized polyether structure were studied.

In EXAMPLES 29–30, polyoxyethylene (400) diesters of myristic ($C_{14}$) and palmitic ($C_{16}$) carboxylic acids, respectively, were dissolved at 10% (w/w) in ethyl acetate. Using the Fiber Spinning Procedure, these spin finish compositions were applied to 1450 denier polypropylene fiber to give a level of approximately 0.75% SOF ester.

In EXAMPLES 31–32, the same experiments were run as in EXAMPLES 29–30, except the derivatized polyethers evaluated were polyoxyethylene "reverse" amides, made by amidating PEG 250 diacid and PEG 600 diacid, respectively.

In EXAMPLES 33–35, the same experiments were run as in EXAMPLES 29–30, except the derivatized polyethers evaluated were polyoxyethylene and polyoxypropylene urethanes, made by reacting a polyoxyalkylene glycol or alcohol with stearyl isocyanate.

In EXAMPLES 36–37, the same experiments were run as in EXAMPLES 29–30, except the derivatized polyethers evaluated were multi-functional polyoxyalkylene esters (i.e., having an ester functionality of greater than 2).

In COMPARATIVE EXAMPLE C23, the same commercial spin finish experiment was run as in COMPARATIVE EXAMPLE C5.

During spin finish application, COF values were measured for each experiment. Each resulting texturized fiber was tufted into a level-loop style carpet using the Carpet Tufting Procedure. Each resulting carpet was then evaluated for soil-resistance (ΔΔE) using the "Walk-On" Soiling Test.

In COMPARATIVE EXAMPLE C24, the same experiment was run as in COMPARATIVE EXAMPLE C6 (scoured carpet control).

Results are presented in TABLE 7.

TABLE 7

| EXAMPLE | Spin Finish | COF | ΔΔE |
|---|---|---|---|
| 29 | PEG400DM | 0.21 | 1.2 |
| 30 | PEG400DP | 0.23 | 1.0 |
| 31 | PEG250DA(stearol)2 | 0.49 | 1.3 |
| 32 | PEG600DA(stearol)2 | 0.29 | 2.0 |
| 33 | MPEG350MSU | 0.24 | 1.4 |
| 34 | PEG400DSU | 0.26 | 2.2 |
| 35 | PPG425DSU | 0.29 | 2.8 |
| 36 | PP-150TS | 0.38 | 1.5 |
| 37 | TP-70TS | 0.53 | 0.8 |
| C23 | SSC 6-789A | 0.22 | 7.2 |
| C24 | scoured | — | 0 |

The data in TABLE 7 illustrate many of the variations possible within the soil-resistant derivatized polyether compositions of the present invention.

EXAMPLES 29–30 show that the hydrocarbon chain length in polyoxypropylene esters can be as low as 14 carbon atoms EXAMPLES 31 and 32 show that the connecting functional group (in this case amide) can be in reverse order without greatly affecting performance of the derivatized polyether-based spin finish.

EXAMPLES 33–35 show that urethane connecting functional groups work well.

EXAMPLES 36–37 show that the derivatized polyethers of this invention may be polyfunctional as well as difunctional.

Examples 38–40 and Comparative Examples C25–C26

In this series of examples, the derivatized polyethers were evaluated as spin finishes for 1710 denier nylon fiber.

In EXAMPLES 38–40, distearamides of various JEFFAMINE™ polyoxyalkylene diamines were dissolved at 10% by weight in ethyl acetate. Using the Fiber Spinning Procedure, these spin finish compositions were applied to the nylon fiber to give a level of approximately 0.75% SOF.

In COMPARATIVE EXAMPLE C25, the commercial spin finish described in COMPARATIVE EXAMPLE C5 was applied at 10% by weight from ethyl acetate to the nylon fiber to give a level of approximately 0.75% SOF.

Each resulting texturized fiber was tufted into a level-loop style carpet using the Carpet Tufting Procedure. Each resulting carpet was then evaluated for soil-resistance using the "Walk-On" Soiling Test.

In COMPARATIVE EXAMPLE C26, the nylon carpet was scoured to remove the spin finish as earlier described in the carpet tufting section.

COF values were also measured for each treated carpet fiber.

Results are presented in TABLE 8.

TABLE 8

| EXAMPLE | Spin Finish | COF | ΔE |
|---|---|---|---|
| 38 | ED-600DSA | 0.24 | 6.5 |
| 39 | ED-900DSA | 0.25 | 9.0 |
| 40 | D400DS | 0.26 | 6.1 |
| C25 | SSC 6-789A | 0.20 | 10.6 |
| C26 | Scoured | — | 7.9 |

The data in TABLE 8 show that, when used as a spin finish for nylon fiber, the polyoxyalkylene distearamides imparted soil-resistant properties to the nylon comparable to and even superior to those exhibited by scoured nylon and superior to those imparted by the commercial spin finish.

Examples 41–42 and Comparative Examples C27–C30

This series of examples illustrates different carpet constructions, e.g., cut pile and natural weave, which can be woven from polypropylene fibers coated with spin finishes based on derivatized polyethers of this invention. This series also illustrates that the derivatized polyethers can be used in aqueous spin finish systems.

In EXAMPLE 41, using the Fiber Spinning Procedure, PEG400DS/MEFOSE1450UU emulsion was applied to polypropylene fiber to give a level of approximately 0.75% SOF. The texturized fiber was tufted into a Berber-style loop carpet. The resulting carpet was then evaluated for soil-resistance using the "Walk-On" Soiling Test.

In COMPARATIVE EXAMPLE C28, the commercial spin finish described in COMPARATIVE EXAMPLE C5 was applied at 10% by weight from water to the polypropylene fiber to give a level of approximately 0.75% SOF. The fiber was then tufted into a Berber-style loop carpet and evaluated for soil-resistance as described in EXAMPLE 41.

In COMPARATIVE EXAMPLE C29, the Berber-style loop carpet prepared in COMPARATIVE EXAMPLE C28 was scoured before evaluation for soil-resistance.

In EXAMPLE 42 and COMPARATIVE EXAMPLES C30 and C31, the same experiments were run as in EXAMPLE 41 and COMPARATIVE EXAMPLES C28 and C29, respectively, except that instead of tufting the fibers into a Berber-style loop carpet, the fibers were tufted into a cut pile carpet.

Each resulting carpet was then evaluated for soil-resistance (ΔΔE) using the "Walk-On" Soiling Test.

Results are presented in TABLE 9.

TABLE 9

| EXAMPLE | Spin Finish | Carpet Type | ΔΔE |
|---|---|---|---|
| 41 | PEG400DS/ MEFOSE1450UU | Berber-style loop | −0.1 |
| C27 | SSC 6-789A | Berber-style loop | 5.8 |
| C28 | scoured | Berber-style loop | 0 |
| 42 | PEG400DS/ MEFOSE1450UU | cut pile | 0.2 |
| C29 | SSC 6-789A | cut pile | 6.5 |
| C30 | scoured | cut pile | 0 |

The data in TABLE 9 show that the soil-resistance of carpet having PEG400DS/MEFOSE1450UU emulsion applied to the fiber was comparable to the soil-resistance of the scoured carpet for both Berber-style loop and cut pile carpets. PEG400DS/MEFOSE1450UU emulsion clearly out performed the commercial spin finish in soil-resistance imparted to both styles of carpet.

Examples 43–44 and Comparative Example C31–C33

This series of examples illustrates the improved soil-resistant performance shown by a spin finish of this invention as compared to a "low-soiling" spin finish and a standard commercial spin finish.

In EXAMPLE 43, polyethylene glycol 300 distearate (PEG300DS) was dissolved at 10% by weight in water. Using, the Fiber Spinning Procedure, the PEG300DS solution was applied to polypropylene fiber at a level of approximately 0.75% SOF.

In EXAMPLE 44, L-1D carpet (fibers treated with PEG400DS/EtFOSE600UU) was evaluated.

In COMPARATIVE EXAMPLE C31, the "low-soiling" Goulston NF-5338 spin finish was applied at 10% by weight from water to polypropylene fiber using the Fiber Spinning Procedure at a level of approximately 0.75% SOF.

In COMPARATIVE EXAMPLE C32, the commercial spin finish described in COMPARATIVE EXAMPLE C5 was applied at 10% by weight from water to polypropylene fiber using the Fiber Spinning Procedure at a level of approximately 0.75% SOF.

During spin finish application, COF values were measured for each experiment. Each resulting texturized fiber was tufted into a level-loop style carpet using the Carpet Tufting Procedure.

In COMPARATIVE EXAMPLE C33, the polypropylene carpet made in COMPARATIVE EXAMPLE C32 was scoured to remove the commercial spin finish.

Each resulting carpet was then evaluated for soil-resistance (ΔΔE) using the "Walk-On" Soiling Test.

Results are presented in TABLE 10.

TABLE 10

| EXAMPLE | Spin Finish | COF | ΔΔE |
|---|---|---|---|
| 43 | PEG300DS | 0.39 | 1.6 |
| 44 | L-1D carpet | 0.31 | 2.1 |
| C31 | NF-5338 | 0.27 | 3.7 |
| C32 | SSC 6-789A | 0.23 | 6.1 |
| C33 | scoured | — | 0 |

The data in TABLE 10 show that carpet made from PEG300DS-treated fiber and the L-1D carpet produced a superior combination of soil-resistant and coefficient of friction properties on polypropylene fiber when compared to the commercial NF-5338 soil-resistant spin finish.

Comparative Example C34

In COMPARATIVE EXAMPLE C34, STANDAFIN™ FCX, a commercially available low soiling spin finish emulsion, was applied as a 10% emulsion at approximately 0.75% SOF to undrawn polypropylene fiber. STANDAFIN™ FCX is described as an excellent low-soiling lubricant that imparts sufficient lubricity to acrylic, polyester and nylon fibers for carding, spinning, and tufting. STANDAFIN™ FCX is believed to be a polyamide made by reacting $C_{10}$–$C_{18}$ fatty acids with triethylenetetramine and is also believed to be described as a secondary fiber finish in U.S. Pat. No. 5,491,004.

The fiber treated with STANDAFIN™ FCX failed to process immediately upon application of this finish.

What is claimed is:

1. In combination with a fibrous substrate, a spin finish composition comprising a polyether selected from the group consisting of $$R^1A—(R^2C)_n—R^2—B—R^3$$

and $$G[(R^4O)_a—R^4—D—R^5]_b$$

wherein:

$R^1$ is an alkyl group or alkaryl group containing at least 13 carbon atoms;

$R^2$ is $—C_2H_4—$, $—C_3H_6—$ or $—C_4H_8—$ or, when adjacent to a —C(O)— moiety of A or B, can be $—CH_2—$;

$R^3$ is hydrogen or is an alkyl group containing between about 1 and about 22 carbon atoms;

$R^4$ is either $—C_2H_4—$, $—C_3H_6—$ or $C_4H_8—$ or, when adjacent to a —C(O)— moiety of D, can be $—CH_2—$;

$R^5$ is an alkyl group containing at least 13 carbon atoms;

A is selected from the group consisting of —C(O)O—, —OC(O)—, —C(O)NH—, —NHC(O)—, —NHC(O)O—, —OC(O)NH— and —NHC(O)NH—;

B is selected from the group consisting of —OC(O)—, —C(O)O—, —NHC(O)—, —C(O)NH—, —OC(O)NH— and —NHC(O)NH—; and n is between 1 and 20;

with the proviso that, when A is —C(O)O— and B is —OC(O)—, n is between 1 and 12;

G is the residue from a polyfunctional nucleophilic initiating species;

D is selected from the group consisting of —C(O)O—, —OC(O)—, —C(O)N—, —NHC(O), —NHC(O)O—, —OC(O)NH— and —NHC(O)NH—;

a is at least 1; and b is either 3 or 4.

2. The combination of claim 1, wherein $R^1$ is a saturated alkyl group containing from about 17 to about 21 carbon atoms.

3. The combination of claim 1, wherein $R^5$ is a saturated alkyl group containing from about 17 to about 21 carbon atoms.

4. The combination of claim 1, wherein A, B, and D are each —C(O)O—.

5. The combination of claim 1, wherein n is between 4 and 10.

6. The combination of claim 1, wherein G is selected from the group consisting of pentaerythritol and trimethylolpropane.

7. The combination of claim 1, wherein said spin finish comprises at least 73% by weight, based on the total weight of solids in said spin finish, of said polyether.

8. The combination of claim 1, wherein said spin finish comprises less than about 10% by weight, based on the total weight of spin finish solids, of fluorochemical.

9. The combination of claim 1, wherein said spin finish comprises less than about 1% by weight, based on the total weight of spin finish solids, of an antistat.

10. The combination of claim 9, wherein said antistat is polyethylene glycol lauryl phosphoric acid.

11. The combination of claim 1, wherein said spin finish comprises less than about 1% by weight, based on the total weight of spin finish solids, of an emulsifier.

12. The combination of claim 11, wherein said emulsifier is sodium dodecylbenzene sulfonate.

13. In combination with a fibrous substrate, a spin finish composition comprising a polyether selected from the group consisting of $C_{17}H_{35}C(O)O(C_2H_4O)_{3.5}C_2H_4OC(O)C_{17}H_{35}$,
$C_{17}H_{35}C(O)O(C_2H_4O)_6C_2H_4OC(O)C_{17}H_{35}$,
$C_{17}H_{35}C(O)O(C_2H_4O)_8C_2H_4OC(O)C_{17}H_{35}$, $C_{17}H_{35}C(O)O(C_2H_4O)_8C_2H_4OH$,
$C_{17}H_{35}C(O)O(C_2H_4O)_7C_2H_4OCH_3$, $C_{21}H_{43}C(O)O(C_2H_4O)_8C_2H_4OC(O)C_{21}H_{43}$,
$C_{17}H_{35}C(O)O(C_3H_6O)_2C_3H_6OCH_3$, $C_{17}H_{35}C(O)O(C_3H_6O)_2C_3H_6OC_4H_9$,
$C_{17}H_{35}C(O)O(C_3H_6O)_2C_3H_6OC(O)C_{17}H_{35}$,
$C_{15}H_{31}C(O)O(C_2H_4O)_8C_2H_4OC(O)C_{15}H_{31}$,
$C_{13}H_{27}C(O)O(C_2H_4O)_8C_2H_4OC(O)C_{13}H_{27}$,
$C_{21}H_{43}C(O)O(C_2H_4O)_8C_2H_4OC(O)C_{21}H_{43}$, $C_{18}H_{37}O(C_2H_4O)_8C_2H_4OC(O)C_{17}H_{35}$,
$C_8H_{17}C_6H_4O(C_2H_4O)_8C_2H_4OC(O)C_{17}H_{35}$,
$C_{18}H_{37}OC(O)CH_2O(C_2H_4O)_4CH_2C(O)OC_{18}H_{37}$,
$C_{17}H_{35}C(O)NHC_3H_6O(C_2H_4O)_{11}C_3H_6NHC(O)C_{17}H_{35}$,
$CH_3O(C_2H_4O)_{12}C_3H_6NHC(O)C_{17}H_{35}$,
$C_{17}H_{35}NHC(O)CH_2O(C_2H_4O)_4CH_2C(O)NHC_{17}H_{35}$,
$C_{18}H_{37}NHC(O)O(C_2H_4O)_7C_2H_4OCH_3$,
$C_{18}H_{37}NHC(O)O(C_3H_6O)_6C_3H_6OC(O)NHC_{18}H_{37}$,
$C_{17}H_{35}C(O)O(C_2H_4O)_4CH_2—C—[CH_2O(C_2H_4O)_4C(O)C_{17}H_{35}]_3$, and
$CH_3CH_2C—[CH_2O(C_2H_4O)_2C(O)C_{17}H_{35}]_3$.

14. The combination of claim 13, wherein the polyether is $C_{17}H_{35}C(O)O(C_2H_4O)_6C_2H_4OC(O)C_{17}H_{35}$.

15. The combination of claim 13, wherein the polyether is $C_{17}H_{35}C(O)O(C_2H_4O)_8C_2H_4OC(O)C_{17}H_{35}$.

16. The combination of claim 13, wherein the polyether is $C_{21}H_{43}C(O)O(C_2H_4O)_8C_2H_4OC(O)C_{21}H_{43}$.

17. The combination of claim 13, wherein the polyether is $C_{17}H_{35}C(O)O(C_3H_6O)_2C_3H_6OC(O)C_{17}H_{35}$.

18. The combination of claim 13, wherein the polyether is $C_{17}H_{35}C(O)NHC_3H_6O(C_2H_4O)_{11}C_3H_6NHC(O)C_{17}H_{35}$.

19. The combination of claim 13, wherein the polyether is $C_{17}H_{35}NHC(O)CH_2O(C_2H_4O)_4CH_2C(O)NHC_{17}H_{35}$.

20. In combination with a fibrous substrate, a-spin finish composition comprising a polyether having the formula $$G[(R^4O)_a—R^4—D—R^5]_b$$

wherein:

$R^4$ is either $—C_2H_4—$, $—C_3H_6—$ or $C_4H_8—$ or, when adjacent to a —C(O)— moiety of D, can be $—CH_2—$;

$R^5$ is an alkyl group containing at least 13 carbon atoms,

G is the residue from a polyfunctional nucleophilic initiating species;

D is selected from the group consisting of —C(O)O—, —OC(O)—, —C(O)N—, —NHC(O), —NHC(O)O—, —OC(O)NH— and —NHC(O)NH—;

a is at least 1; and b is either 3 or 4.

21. The combination of claim 20, wherein $R^5$ is a saturated alkyl group containing from about 17 to about 21 carbon atoms.

22. The combination of claim 20, wherein D is selected from the group consisting of —C(O)N—, —NHC(O), —NHC(O)O—, —OC(O)NH— and —NHC(O)NH—.

23. The combination of claim 20, wherein D is —C(O)O—.

24. The combination of claim 20, wherein G is selected from the group consisting of pentaerythritol and trimethylolpropane.

25. The combination of claim 20, wherein said spin finish comprises at least 73% by weight, based on the total weight of solids in said spin finish, of said polyether.

26. The combination of claim 20, wherein said spin finish comprises less than about 10% by weight, based on the total weight of spin finish solids, of fluorochernical.

27. The combination of claim 20, wherein said spin finish comprises less than about 1% by weight, based on the total weight of spin finish solids, of an antistat.

28. The combination of claim 27, wherein said antistat is polyethylene glycol lauryl phosphoric acid.

29. The combination of claim 21, wherein said spin finish comprises less than about 1% by weight, based on the total weight of spin finish solids, of an emulsifier.

30. The combination of claim 29, wherein said emulsifier is sodium dodecylbenzene sulfonate.

31. In combination with a fibrous substrate, a spin finish composition comprising a polyether having the formula $$R^1A—(R^2O)_n—R^2—B—R^3$$

wherein:

$R^1$ is an alkyl group or alkaryl group containing at least 13 carbon atoms;

$R^2$ is $—C_2H_4—$, $—C_3H_6—$ or $—C_4H_8—$ or, when adjacent to a —C(O)— moiety of A or B, can be $—CH_2—$;

$R^3$ is hydrogen or is an alkyl group containing between about 1 and about 22 carbon atoms;

A is selected from the group consisting of —C(O)O—, —C(O)NH—, —NHC(O)—, —NHC(O)O—, —OC(O)N— and —NHC(O)NH—, B is selected from the group consisting of —OC(O)—, —C(O)O—, —NHC(O)—, —C(O)NH—, —OC(O)NH— and —NHC(O)NH—; and n is between 1 and 20;

with the proviso that, when $R^3$ is hydrogen, B is —O— (i.e., forming an alcohol group), and with the additional proviso that, when A is —C(O)O— and B is —OC(O—, n is between 1 and 12.

32. The combination of claim 31, wherein $R^1$ is a saturated alkyl group containing from about 17 to about 21 carbon atoms.

33. The combination of claim 31, wherein n is between 4 and 10.

34. The combination of claim 31, wherein said spin finish comprises at least 73% by weight, based on the total weight of solids in said spin finish, of said polyether.

35. The combination of claim 31, wherein said spin finish comprises less than about 10% by weight, based on the total weight of spin finish solids, of fluorochemical.

36. The combination of claim 31, wherein said spin finish comprises less than about 1% by weight, based on the total weight of spin finish solids, of an antistat.

37. The combination of claim 36, wherein said antistat is polyethylene glycol lauryl phosphoric acid.

38. The combination of claim 31, wherein said spin finish comprises less than about 1% by weight, based on the total weight of spin finish solids, of an emulsifier.

39. The combination of claim 38, wherein said emulsifier is sodium dodecylbenzene sulfonate.

40. In combination with a fibrous substrate, a spin finish composition comprising a polyether having the formula $$R^1A—(R^2O)_n—R^2—B—R^3$$

wherein:

$R^1$ is an alkyl group or alkaryl group containing at least 13 carbon atoms;

$R^2$ is $—C_2H_4—$, $—C_3H_6—$ or $—C_4H_8—$ or, when adjacent to a —C(O)— moiety of A or B, can be $—CH_2—$;

$R^3$ is hydrogen or is an alkyl group containing between about 1 and about 22 carbon atoms;

A is selected from the group consisting of —C(O)O—, —OC(O)—, —C(O)NH—, —NHC(O)—, —O—, —NHC(O)O—, —OC(O)NH— and —NHC(O)NH—;

B is selected from the group consisting of —OC(O)—, —NHC(O)—, —C(O)NH—, —OC(O)NH— and —NHC(O)NH—; and n is between 1 and 20;

with the proviso that, when $R^3$ is hydrogen, B is —O— (i.e., forming an alcohol group), and with the additional proviso that, when A is —C(O)O— and B is —OC(O)—, n is between 1 and 12.

41. The combination of claim 40, wherein $R^1$ is a saturated alkyl group containing from about 17 to about 21 carbon atoms.

42. The combination of claim 40, wherein n is between 4 and 10.

43. The combination of claim 40, wherein said spin finish comprises at least 73% by weight, based on the total weight of solids in said spin finish, of said polyether.

44. The combination of claim 40, wherein said spin finish comprises less than about 10% by weight, based on the total weight of spin finish solids, of fluorochemical.

45. The combination of claim 40, wherein said spin finish comprises less than about 1% by weight, based on the total weight of spin finish solids, of an antistat.

46. The combination of claim 45, wherein said antistat is polyethylene glycol lauryl phosphoric acid.

47. The combination of claim 40, wherein said spin finish comprises less than about 1% by weight, based on the total weight of spin finish solids, of an emulsifier.

48. The combination of claim 47, wherein said emulsifier is sodium dodecylbenzene sulfonate.

* * * * *

UNITED STATES PATENT AND TRADEMARK OFFICE

CERTIFICATE OF CORRECTION

PATENT NO. : 6,537,662 B1 
DATED : March 25, 2003
INVENTOR(S) : Kamrath, Robert F.

It is certified that error appears in the above-identified patent and that said Letters Patent is hereby corrected as shown below:

Title page,
Item [57], ABSTRACT,
Line 1, delete "select" and insert -- selected --, therefor.

Column 1,
Line 39, after "article" insert -- . --.

Column 2,
Line 7, after "problems" insert -- . --.
Line 7, after "See," delete "e g ," and insert -- e.g., --, therefor.
Line 32, after "agent" insert -- . --.
Column 5,
Line 56, after "$R^1A$-$(R^2O)_n$" delete "$R^2$-B-$R^3$" and insert -- -$R^2$-B-$R^3$ --, therefor.
Line 57, delete "$G[(R^4O)_a$-$R^4$-D-$R^5]_t$" and insert -- $G[(R^4O)_a$-$R^4$-D-$R^5]_b$ --, therefor.

Column 7,
Line 63, after "20," insert -- and --.
Line 64, after "13" insert -- , --.

Column 8,
Line 9, delete "$C_2H_4OC(G)$" and insert -- $C_2H_4OC(O)$ --, therefor.
Line 41, after "20%)" delete "," and insert -- ; --, therefor.
Line 42, after "5%)" delete "," and insert -- ; --, therefor.
Line 64, after "journal" insert -- , --.
Line 65, delete "Polyethets" and insert -- Polyethers --, therefor.

Column 9,
Line 6, delete "0 5%" and insert -- 0.5% --, therefor.
Line 26, after "(BuTPG)" insert -- ; --.
Line 28, after "ratio" insert -- . --.
Table 1, (Chemical Structure of Esterified Polyether), line 2, delete "$(C_2H_4O)_{35}$" and insert -- $(C_2H_4O)_{3.5}$ --, therefor.
Table 1 (Carboxylic Acid (moles)), line 3, delete "stearic acid (3)" and insert -- stearic acid (2) --, therefor.
Table 1 (Carboxylic Acid (moles)), line 22, delete "stearic acid (1)" and insert -- stearic acid (2) --, therefor.

UNITED STATES PATENT AND TRADEMARK OFFICE

CERTIFICATE OF CORRECTION

PATENT NO. : 6,537,662 B1
DATED : March 25, 2003
INVENTOR(S) : Kamrath, Robert F.

It is certified that error appears in the above-identified patent and that said Letters Patent is hereby corrected as shown below:

Column 11,
Line 42, delete "1-L" and insert -- I-L --, therefor.
Line 57, delete "NPEG" and insert -- MPEG --, therefor.

Column 12,
Line 51, after "solids" insert -- . --.
Line 57, delete "CARPBOWAX™" and insert -- CARBOWAX™ --, therefor.

Column 15,
Line 48, delete "calculations" and insert -- calculation --, therefor.

Column 16,
Line 13, delete "calorimetric" and insert -- colorimetric --, therefor.
Line 29, delete "calorimetric" and insert -- colorimetric --, therefor.

Column 18,
Line 9, delete "(AAE)" and insert -- ($\Delta\Delta E$) --, therefor.

Column 19,
Line 25, after "composition" insert -- . --.

Column 22,
Line 37, after "atoms" insert -- . --.

Column 24,
Line 13, delete "Example" and insert -- Examples --, therefor.
Line 15, after "Using" delete ",".

Column 25,
Line 7, delete "$R^1A\text{-}(R^2C)_n$" and insert -- $R^1A\text{-}(R^2O)_n$ --, therefor.
Line 37, delete "-NHC(O)," and insert ---NHC(O)–, --, therefor.

UNITED STATES PATENT AND TRADEMARK OFFICE

CERTIFICATE OF CORRECTION

PATENT NO. : 6,537,662 B1
DATED : March 25, 2003
INVENTOR(S) : Kamrath, Robert F.

It is certified that error appears in the above-identified patent and that said Letters Patent is hereby corrected as shown below:

Column 26,
Line 44, delete "a-spin" and insert -- a spin --, therefor.
Line 49, delete "$C_4H_8$–" and insert -- –$C_4H_8$– --, therefor.
Line 51, after "atoms" delete "," and insert -- ; --, therefor.
Line 56, delete "-NHC(O)," and insert -- -NHC(O)–, --, therefor.
Line 64, delete "-NHC(O)," and insert -- -NHC(O)–, --, therefor.

Column 27,
Line 9, delete "fluorochernical" and insert -- fluorochemical --, therefor.
Lines 33-34, delete "-OC(O)N-" and insert -- -OC(O)NH- --, therefor.
Line 34, after "-NHC(O)NH-" delete "," and insert -- ; --, therefor.
Line 42, delete "–OC(O–" and insert -- –OC(O)– --, therefor.

Signed and Sealed this

Second Day of November, 2004

JON W. DUDAS
*Director of the United States Patent and Trademark Office*